US005624323A

United States Patent [19]

Delaney et al.

[11] Patent Number: 5,624,323

[45] Date of Patent: Apr. 29, 1997

[54] AUTOMATIC PINSETTER

[75] Inventors: Francois Delaney, L'Assomption; Viateur Guay, Charlesbourg; Carol Simard, Beaupre; Jean-Yves Dion, Chrysostome; Lucien Rochefort, Beauport, all of Canada

[73] Assignee: Mendes Inc., Ste-Foy, Canada

[21] Appl. No.: 524,099

[22] Filed: Aug. 18, 1995

Related U.S. Application Data

[63] Continuation of Ser. No. 261,725, Jun. 17, 1994, abandoned, which is a continuation-in-part of Ser. No. 79,164, Jun. 18, 1993, abandoned.

[51] Int. Cl.[6] ..... A63D 5/08

[52] U.S. Cl. ..... 473/73; 473/85; 473/92; 473/91

[58] Field of Search ..... 473/54, 64, 73, 473/85, 87, 88, 89, 90, 91, 92, 97, 98

[56] References Cited

U.S. PATENT DOCUMENTS

| | | | |
|---|---|---|---|
| 1,181,649 | 5/1916 | Downey | 473/85 |
| 1,190,646 | 7/1916 | Hedenskoog . | |
| 1,190,648 | 7/1916 | Hedenskoog . | |
| 1,524,241 | 1/1925 | Hedenskoog | 473/85 |
| 1,692,796 | 11/1928 | Bishop | 473/85 |
| 2,688,485 | 9/1954 | Montooth . | |
| 2,728,575 | 12/1955 | Cross . | |
| 2,860,877 | 11/1958 | Came . | |
| 2,947,541 | 8/1960 | Came et al. . | |
| 2,962,284 | 11/1960 | Bilowz . | |
| 2,964,317 | 12/1960 | Gruss . | |
| 3,083,017 | 3/1963 | Bilowz . | |
| 3,174,751 | 3/1965 | Martin . | |
| 3,191,933 | 6/1965 | Kalbfleisch . | |
| 3,219,345 | 11/1965 | Rogers . | |
| 3,224,767 | 12/1965 | Webb et al. . | |
| 3,231,272 | 1/1966 | Blewitt, Jr. . | |
| 3,245,684 | 4/1966 | Congelli et al. . | |
| 3,251,597 | 5/1966 | Saunders . | |
| 3,292,925 | 12/1966 | Barry et al. . | |
| 3,297,322 | 1/1967 | Ernst et al. . | |
| 3,315,961 | 4/1967 | Congelli et al. . | |
| 3,386,734 | 6/1968 | Congelli et al. . | |
| 3,411,780 | 11/1968 | Mellon . | |
| 3,738,648 | 6/1973 | Strickland . | |
| 3,807,732 | 4/1974 | Congelli . | |
| 5,039,095 | 8/1991 | Buckley . | |
| 5,152,525 | 10/1992 | Brim et al. . | |

*Primary Examiner*—William M. Pierce
*Attorney, Agent, or Firm*—McCormick, Paulding & Huber

[57] ABSTRACT

An automatic pinsetter employing magnetically responsive bowling pins, an elevator mechanism for retrieving bowling pins from a pit area adjacent an end portion of a bowling alley and for transporting the same to a pin discharge station above a transfer mechanism. The pins are arranged in bowling array on a transfer mechanism which is thereafter moved horizontally beneath a pinsetting mechanism. The pinsetting mechanism employs magnetic means for elevating the pins, the transfer mechanism is retracted from beneath the pinsetting mechanism, and the latter thereupon deposits the pins on the bowling alley in bowling array. The pinsetting mechanism is also adapted to pick-up and replace remaining upright pins after a first ball has been thrown whether the pins reside in "on spot" or "off spot" positions.

30 Claims, 30 Drawing Sheets

AUTOMATIC PINSETTER

CROSS-REFERENCE TO RELATED APPLICATION

This is a continuation of application Ser. No. 08/261,725 filed on Jun. 17, 1994, now abandoned, which is a continuation in part of application Ser. No. 08/079,164, filed on Jun. 18, 1993, now abandoned.

BACKGROUND OF THE INVENTION

This invention relates generally to automatic pinsetters of the type which retrieve bowling pins from a pit area adjacent a rear end portion of a bowling alley and which deposit the same in bowling array on the rear end portion of the bowling alley.

Automatic pinsetters heretofore available have employed mechanical means for retrieving, manipulating and orienting bowling pins as required to reposition or "set" the same in a desired bowling array on a rear end portion of a bowling alley. The pinsetters also mechanically retrieve and raise remaining upright pins after a first ball has been thrown, the alley thus being cleared of fallen pins or "deadwood", and thereafter replace the upright pins on the bowling alley.

While pinsetters of the type mentioned have been satisfactory in general, they are usually highly complex mechanical devices, necessarily expensive with regard both to manufacture and initial cost as well as repair and maintenance throughout their useful life. For example, it is known that repair and maintenance costs associated with available automatic pinsetters usually constitute the most expensive single item in the operation of a bowling alley.

It is a general object of the present invention to provide an automatic pinsetter of greatly simplified design and construction which is capable of manufacture at economic advantage and which exhibits a high degree of durability over a long service life, repair and maintenance costs thus being minimized.

Another object of the present invention is to reduce the number of moving parts in a simplified and yet highly efficient pinsetter to a few hundred, prior art pinsetters having employed moving parts in the thousands.

Another object of the present invention is to eliminate the purely mechanical and rather awkward manipulation and orientation of bowling pins and to substitute at least in part the use of magnetism.

Still another object of the present invention is to provide an automatic pinsetter and a plurality of magnetically responsive bowling pins for use therewith, the pinsetter serving to retrieve bowling pins from a pit area adjacent a rear end of a bowling alley and manipulating and orienting the same magnetically for deposit in a desired bowling array on a rear end portion of the alley.

A still further object of the present invention resides in the provision of an automatic pinsetter for retrieving magnetically responsive bowling pins from a pit area adjacent a rear end of a bowling alley for transporting and arranging the same in an upright attitude and in a desired bowling array above a pre-selected area of the bowling alley, and for precisely depositing the same on the area in bowling array.

A still further object of the invention resides in the provision of a pinsetter for both retrieving magnetically responsive bowling pins from a pit area employing magnetic means and for handling and depositing the bowling pins on the bowling alley in bowling array employing magnetic means.

A further object of the present invention resides in the provision of an automatic pinsetter having magnetic means for picking up and raising remaining upright bowling pins after a first ball has been thrown, thus accommodating clearing of the bowling alley of fallen bowling pins, and for replacing the bowling pins on the bowling alley.

A still further object of the present invention resides in the provision of an automatic pinsetter having magnetic means for efficiently picking-up remaining upright "off spot" bowling pins, raising the same and thus accommodating clearing of fallen pins from the bowling alley and for replacing the bowling pins on the alley precisely in their "off spot" positions.

Still another object of the present invention is to provide magnetically responsive bowling pins highly efficient in their co-operation with magnetic means in a automatic pinsetter and which yet act and react precisely in the same manner as conventional bowling pins.

A still further object of the present invention resides in the provision of bowling ball retrieval apparatus of a simplified and yet highly efficient and reliable construction.

A still further object of the present invention is to provide a simplified design and construction as aforesaid and which is extremely compact in configuration particularly in the longitudinal direction of the bowling alley.

SUMMARY OF THE INVENTION

In fulfillment of the foregoing objects, a plurality of magnetically responsive bowling pins are provided and may take the form of conventional bowling pins having metal or other magnetically responsive material embedded therein. In accordance with the presently preferred practice, conventional bowling pins are provided at upper end portions with magnetic means which may be small permanent magnets embedded therein, a multiplicity of small particles of magnetic material dispersed throughout an upper end portion thereof, etc. While magnetically responsive means may be otherwise incorporated into the bowling pins, it is also presently preferred that such means be located at the upper end portions or heads of the bowling pins. The types of bowling pins so treated may vary widely within the scope of the invention and may include all presently known as well as future types and configurations of bowling pins.

The automatic pinsetter of the present invention is also capable of accommodating all presently known types and configurations of bowling pins and it is contemplated that it be readily adapted to any future bowling pins.

The automatic pinsetter comprises initially an elevator mechanism which retrieves bowling pins seriatim from a pit area adjacent a rear end portion of a bowling alley and which transports the same upwardly for delivery to a pin discharge station. A pin retrieval means operatively associated with the elevator mechanism picks up bowling pins individually from the pit area and in accordance with one presently preferred practice, the pin retrieval means includes magnetic means for picking up bowling pins magnetically responsive at upper end portions and for carrying the same in an upright attitude during transport to the pin discharge station. More particularly, the pin retrieval means comprises a series of magnets each adapted to pick-up an individual bowling pin in an upright attitude and each supported by a flexible line attached at an upper end to an endless conveyor forming a part of the elevator mechanism. The elevator mechanism extends generally vertically from a loading station adjacent the pit area to the aforesaid pin discharge station with the magnets and support lines spaced apart therealong. The flexible lines supporting the magnetics accommodate horizontal movement of the magnets in "seeking" or "fishing" for magnetically responsive pins at the pin loading station. Permanent magnets are presently preferred in the pin retrieval means but it is also possible to employ electromagnets with the flexible support lines for the magnets comprising flexible electrical conductors and with a commutation track extending along and adjacent the endless conveyor. Short conductors extending from the flexible conductors and slidably received in electrically conductive relationship with the commutation track may also be employed.

At the pin discharge station at least one gate is provided and is operable to discharge pins from the conveyor to a pin transfer mechanism. The pin transfer mechanism is adapted at a loading station adjacent the pin discharge station to selectively receive bowling pins seriatim from the conveyor and is adapted further to transfer the pins in bowling array to a pin delivery station. An indexible rotary table having a plurality of upwardly open cradles thereon for receiving and holding bowling pins in an upright attitude preferably forms a part of the transfer mechanism. The cradles are arranged to receive and hold a like plurality of bowling pins in a bowling array and the aforementioned gate and table are operable in timed relationship whereby to deposit an individual bowling pin in each cradle.

Preferably, the conveyor extends generally horizontally and linearly for a substantial distance at the pin discharge station and there are at least two horizontally spaced apart gates at said station adjacent the linear path of movement of the conveyor. A fixed stop is also provided above the center of the rotary table and is also in alignment with the linear path of movement of the conveyor. The gates are operable selectively when a cradle is moved by an indexing movement of the table to obstruct the passage of a bowling pin and to cause the pin to disengage from its magnet and to fall into the cradle. Thus, in operation the gates are operable to cause bowling pins to fall into radially spaced cradles on the table along and beneath the linear path of movement of the conveyor. Similarly, the fixed stop above the center of the table causes a pin carried by a magnet on a flexible line beneath the conveyor to be obstructed in its movement and to fall into the center cradle on the table.

When ten (10) magnetically responsive bowling pins are provided in a conventional triangular arrangement there are, of course, ten (10) cradles on the rotary table in similar arrangement with the two gates operable on table indexing movements of 30° and multiples thereof so as to fill all cradles on the table.

The rotary table of one preferred transfer mechanism is also adapted to be moved bodily between its loading station and a delivery station, the latter being spaced above and in precise vertical alignment with a desired location of the bowling array on the bowling alley. At its delivery station, the transfer mechanism co-operates with a vertically moveable pinsetting mechanism which is adapted to accept and lift the pins in bowling array from the rotary table and to lower and deposit the same in bowling array on the bowling alley. The pinsetting mechanism includes magnetic means for selectively magnetically holding and releasing magnetically responsive pins whereby to lift the same from the transfer mechanism and thereafter to deposit the same on the bowling alley. More particularly, the pinsetting mechanism includes a plurality of magnets in substantially co-planner horizontal arrangement and in bowling array corresponding precisely with the cradles on the table and the bowling alley therebeneath. At an intermediate position of the pinsetting mechanism above but closely adjacent the rotary table, the bowling pins are removed upwardly from their cradles by the magnets of the pinsetting mechanism and, on movement of the rotary table away from the delivery station toward its loading station, the pinsetting mechanism is further moveable vertically downwardly to a lowermost or discharge position for deposit of the pins on the bowling alley.

The pinsetting mechanism also preferably includes separator means between its magnets and the tops of sub-adjacent heads of bowling pins together with a means for effecting at least limited generally vertical upward movement of each magnet. The separator means serves to obstruct corresponding upward movement of a bowling pin head and thereby causes the magnet to release the pin. When the magnet is moved downwardly into close proximity with the separator means the latter is rendered ineffective allowing the magnet to magnetically hold the sub-adjacent bowling pin. Various means for vertically moving the magnets take the form of individual support lines for each magnet and actuator means for raising and lower the support lines in unison, an individual housing for each magnet and an associated vacuum chamber with means for selectively evacuating the chambers and thus raising and lowering the magnets, and a carrier supporting the magnets in common and providing the necessary relative vertical movement between the magnets and the separator means. The last mentioned device employing the carrier is present preferred and includes spring biasing means for individual separator plates co-operable with small containers containing liquid and magnets equipped with float means. The floating magnets provide for horizontal magnet movement in a slightly elevated position whereby the magnets seek the heads of "off spot" pins rather then tilting or otherwise moving the pins. Similarly, the magnets suspended on flexible lines and the vacuum equipped magnets tend to move and seek such "off spot" pins. An electro-magnet system may also be employed and provided with high and low voltage sources respectively for holding pins and for seeking the same as aforesaid.

In addition to aiding in the release of the bowling pins from the magnets, the separator means also serve to steady remaining upright pins after a first ball has been thrown and it is desired to pick-up such pins for an alley clearing or sweeping operation therebeneath and thereafter return the same to the bowling alley. Thus, individual separator plates engage the heads of remaining upright pins, the magnets of the pinsetting mechanism then exert reduced magnetic influence thereon moving horizontally if the pins are in an "off spot" position, the pins are raised for the alley clearing operation, and the pins are thereafter replaced precisely in their "off spot" positions.

The automatic pinsetter of the present invention may also include an improved bowling ball retrieval apparatus which grips and holds a bowling ball for transport. The apparatus comprises a suction cup having a plurality of vacuum compartments therewithin, vacuum generating means selectively connectable therewith and a support means for the cup moveable between cup loading and unloading stations. A small percentage of the compartments in the cup provide sufficient gripping action on a bowling ball to hold the same irrespective of the position of finger holes in the ball. Thus, the apparatus causes the cup to engage a ball and automatically transport the same through an opening in a "kickback" to a ball return mechanism.

In a second embodiment of the invention, a somewhat conventional elevator is provided and is mechanical in construction and operation with a magnetic transfer mechanism adapted to accept bowling pins seriatim from the elevator at a discharge station. The transfer mechanism includes a conveyor having "pick-up" and "discharge runs" with magnetic means in the form of permanent magnets spaced therealong. Bowling pins delivered to the discharge station in upright attitude by the elevator are engaged and picked up by the permanent magnets and are transported to the discharge "run" of the conveyor. A series of discharge devices spaced along the discharge run are operable selectively to dislodge bowling pins from their magnets and to cause the same to fall into individual holders of a bowling pin collator. The discharge devices include a "knife like" separator which enters between the head of a bowling pin and its associated magnet for positive discharge of the bowling pins. The collator includes a linear series of pin holders and preferably has seven (7) such pin holders each with an associated moveable gate. The gates of the pin holders are operated selectively to load a plurality of bowling pins into cradles of a carrier also forming a part of the transfer mechanism.

The carrier portion of the transfer mechanism is adapted for horizontal movement and is expandable and contractible horizontally whereby to selectively arrange a plurality of upwardly open cradles thereon in a conventional triangular bowling array and in a plurality of linear series or rows of cradles. When ten (10) pins bowling pins are provided in a conventional arrangement, the carrier contracts from its expanded triangular array condition to arrange its cradles in two series or rows with three (3) cradles in a front row and seven (7) cradles in a rear row. The three cradles of the front row comprise the front cradle of the triangular arrangement and the two cradles of the second row of the triangular arrangement. The seven cradles of the rear row comprise the three cradles of the third row of the triangular bowling arrangement and the four (4) cradles of the fourth and rearwardmost row of the triangular arrangement.

As will be apparent, the expansion and contraction of the carrier of the transfer mechanism provides for a substantial reduction in the length of the mechanism and thus a corresponding reduction in the overall length of the pinsetter, a desirably compact construction and arrangement of the pinsetter being thus achieved.

In its expanded condition the carrier of the transfer mechanism presents the bowling pins in Conventional triangular array beneath a pinsetting mechanism for subsequent deposit in bowling array on the alley therebeneath. The pinsetting mechanism comprises ten (10) magnetic means in triangular bowling array as in the foregoing embodiment, but the arrangement of the magnetic means is simplified and yet highly efficient in operation. A small container is provided with a permanent magnet fitted with a float disposed in the container in a liquid permitting a degree of horizontal movement of the magnet as well as vertical movement thereof to the bottom of the container for the application of magnetic holding force on the head of a bowling pin therebeneath. As described above, horizontal movement of the magnets and their floats accommodates a "seeking" operation of the magnets relative to the heads of "off spot" bowling pins. The vertical movement of the magnets to the bottom of the containers accommodates a "pick-up" operation of the magnets relative to the bowling pins. Release of the bowling pins is accomplished by a rapid upward acceleration of the pinsetting mechanism at the beginning of an upward movement of the mechanism. Such initial rapid acceleration or "snapping" movement results in separation of the bottom of the containers from the heads of subadjacent bowling pins with the magnetic force of the magnets thus being overcome by the weight and inertia of the bowling pins.

DESCRIPTION OF THE PREFERRED EMBODIMENTS

Figure 1:
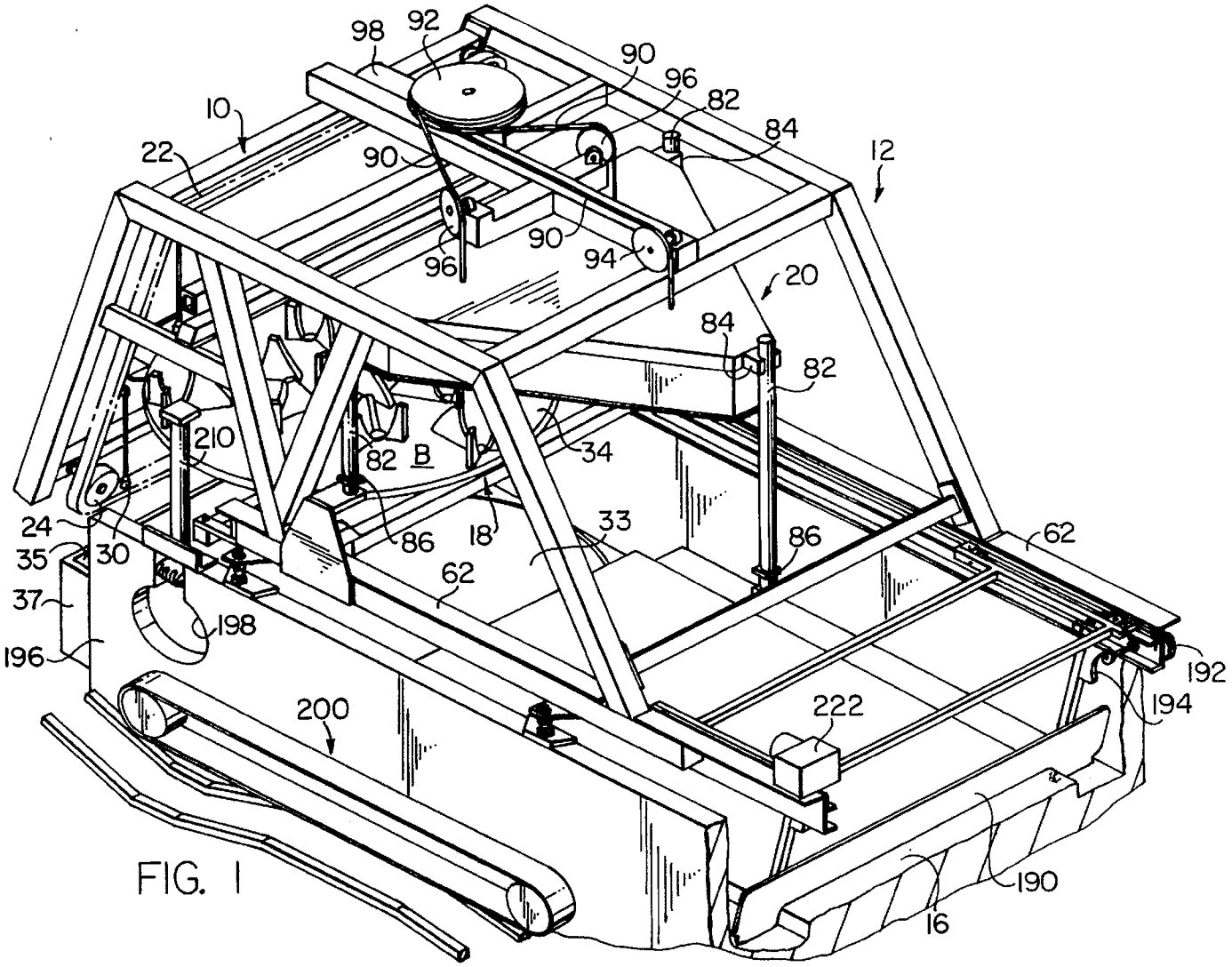
FIG. 1 of the drawings is a perspective view showing the automatic pinsetter of the present invention.

Referring initially to FIGS. 1 through 4, it will be observed that an elevator mechanism is indicated generally by the reference numeral 10 as forming a part of an automatic pinsetter indicated generally by the reference numeral 12. The elevator mechanism operates to retrieve bowling pins seriatim from a pit area 14 adjacent a rear end of a bowling alley 16 and to transport the same upwardly for delivery to a pin discharge station A. A transfer mechanism indicated generally at 18 is moveable between a loading station B therefor adjacent and beneath the pin discharge station A to a pin delivery station C spaced horizontally forwardly from the loading station B and above the bowling alley 16. The transfer mechanism receives the bowling pins seriatim from the elevator mechanism at its loading station B and transfers the pins in bowling array to the pin delivery station C. At the pin delivery station C a vertically moveable pinsetting mechanism indicated generally at 20 is adapted to accept the bowling pins in bowling array and then thereafter to deposit the same in bowling array on the bowling alley therebeneath. When the automatic pinsetter is provided with a plurality of magnetically responsive bowling pins as aforesaid, the pinsetting mechanism is provided with magnetic means for selectively magnetically holding and releasing the magnetically responsive pins whereby to remove the same from the transfer mechanism 18 and to deposit the same on the bowling alley 16. The pinsetting mechanism is moveable downwardly from its elevated position shown to an intermediate position above the transfer mechanism 18 shown in FIG. 2 at the delivery station C. At its intermediate position the pinsetting mechanism magnetically engages the bowling pins in bowling array and then lifts the same to allow the transfer mechanism 18 to be withdrawn rearwardly to its loading station B. The pinsetting mechanism thereupon moves vertically downwardly again to deposit the bowling pins on the bowling alley 16.

Figure 3:
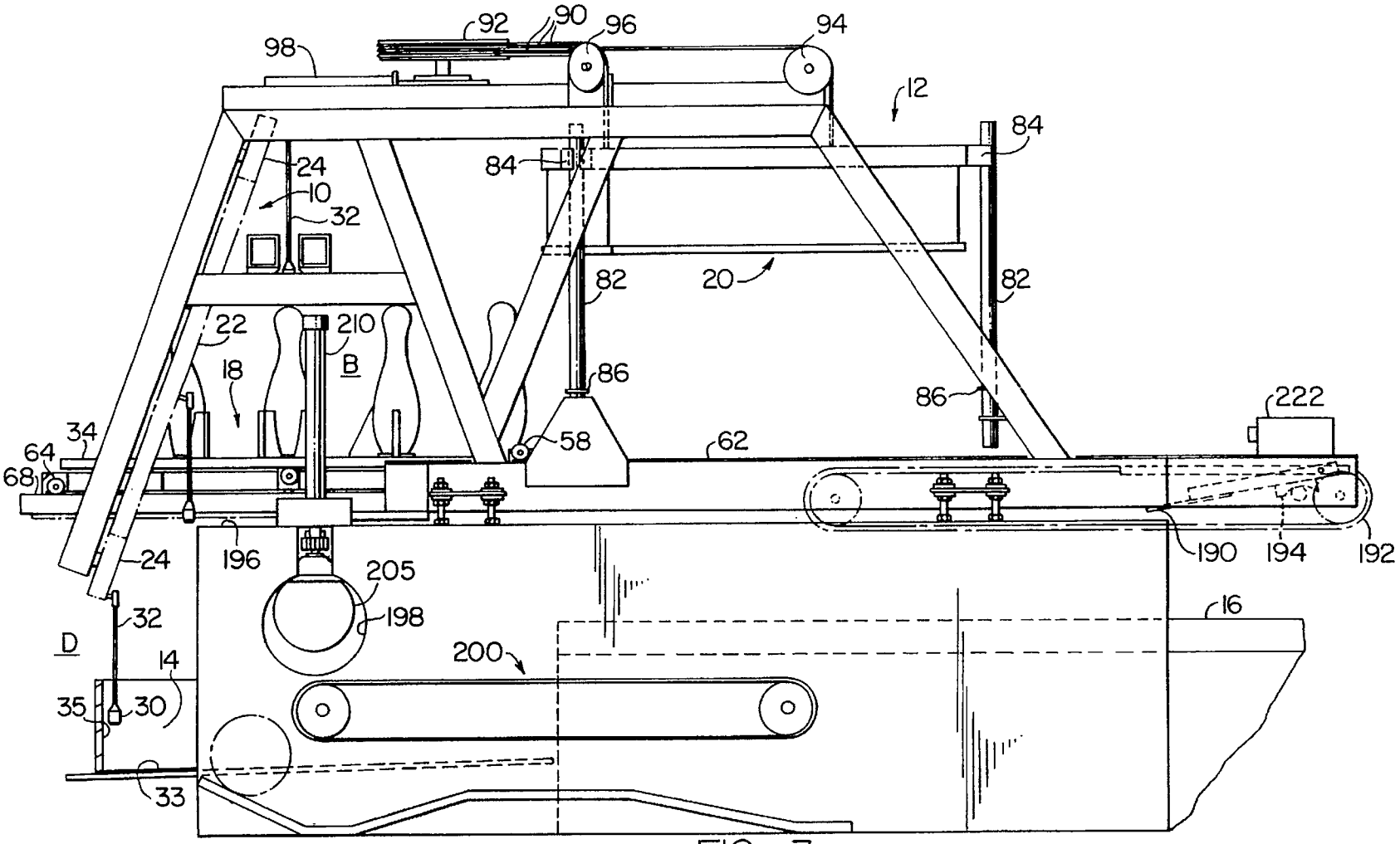
FIG. 3 is a partially schematic side view of the pinsetter of FIGS. 1 and 2.
Figure 4:
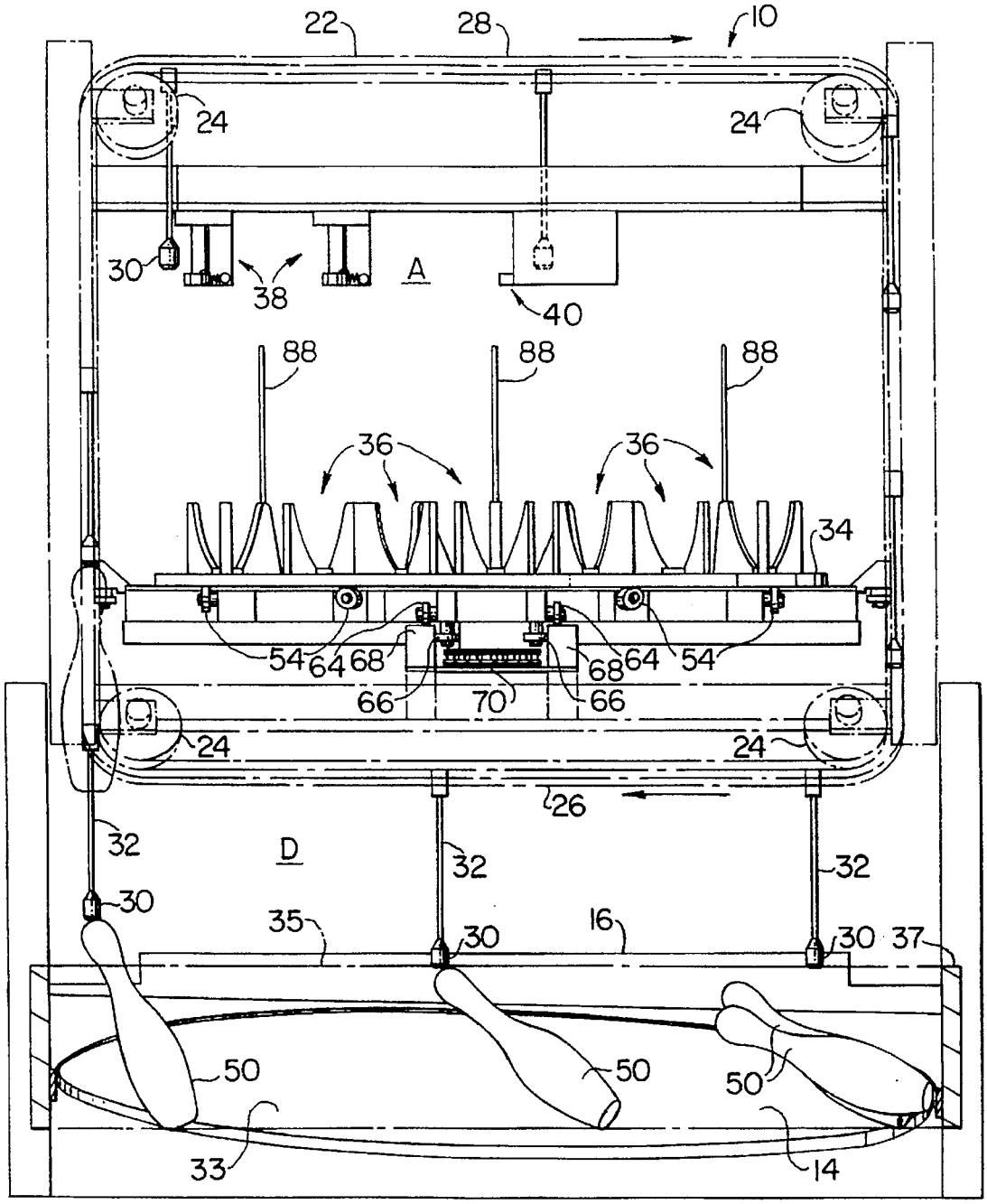
FIG. 4 is a rear end elevational view of the automatic pinsetter.

Reverting now to the elevator mechanism 10 and with particular reference to FIGS. 3 and 4, it will be observed that the elevator mechanism comprises an endless conveyor which may comprise a chain or belt but is shown in the form of a sprocket chain 22 which extends generally vertically from a loading station D therefor adjacent the pit area to the pin discharge station A. More particularly, the conveyor chain 22 is arranged in a generally rectangular configuration viewed from the rear of the pinsetter and is provided with four (4) sprockets 24,24 at its corners. The conveyor may be driven, for example, by a direct current electric motor operatively associated with one of the sprockets 24,24 and, as illustrated, the conveyor progresses in a clockwise direction with a leftwardly moving substantially horizontal lower run 26 and a rightwardly moving substantially horizontal upper run 28. As best illustrated in FIG. 3 the conveyor is inclined forwardly above the pin discharge station A to provide clearance for depending magnets 30,30 to be described hereinbelow.

In one preferred form of the present invention, both the elevator mechanism 10 and the pinsetting mechanism 20 employ magnetic means for lifting, manipulating, and transporting magnetically responsive bowling pins, the pins preferably being magnetically responsive at upper end portions thereof. Further, in the embodiment of the invention illustrated in FIGS. 3 and 4, permanent magnets 30,30 are employed and each magnet is supported by a flexible line 32 attached at an upper end to the conveyor and carrying the depending magnet 30 at its lower end. Between five (5) and nine (9) magnets and support lines are provided in substantially equally spaced relationship along the conveyor chain 22 and, more particularly, eight (8) such magnets and flexible support lines are illustrated in FIGS. 3 and 4. As the magnets 30,30 move leftwardly along the lower run 26 of the conveyor 22 through the pin loading station D in the pit area 14, the magnets tend to "seek" or "fish" for and pick-up bowling pins residing in indiscriminate orientation in the pit area 14. That is, the flexible lines 32,32 allow the magnets to move in a generally horizontal plane whereby to seek and attach to the head of a bowling pin therebeneath.

Figure 2:
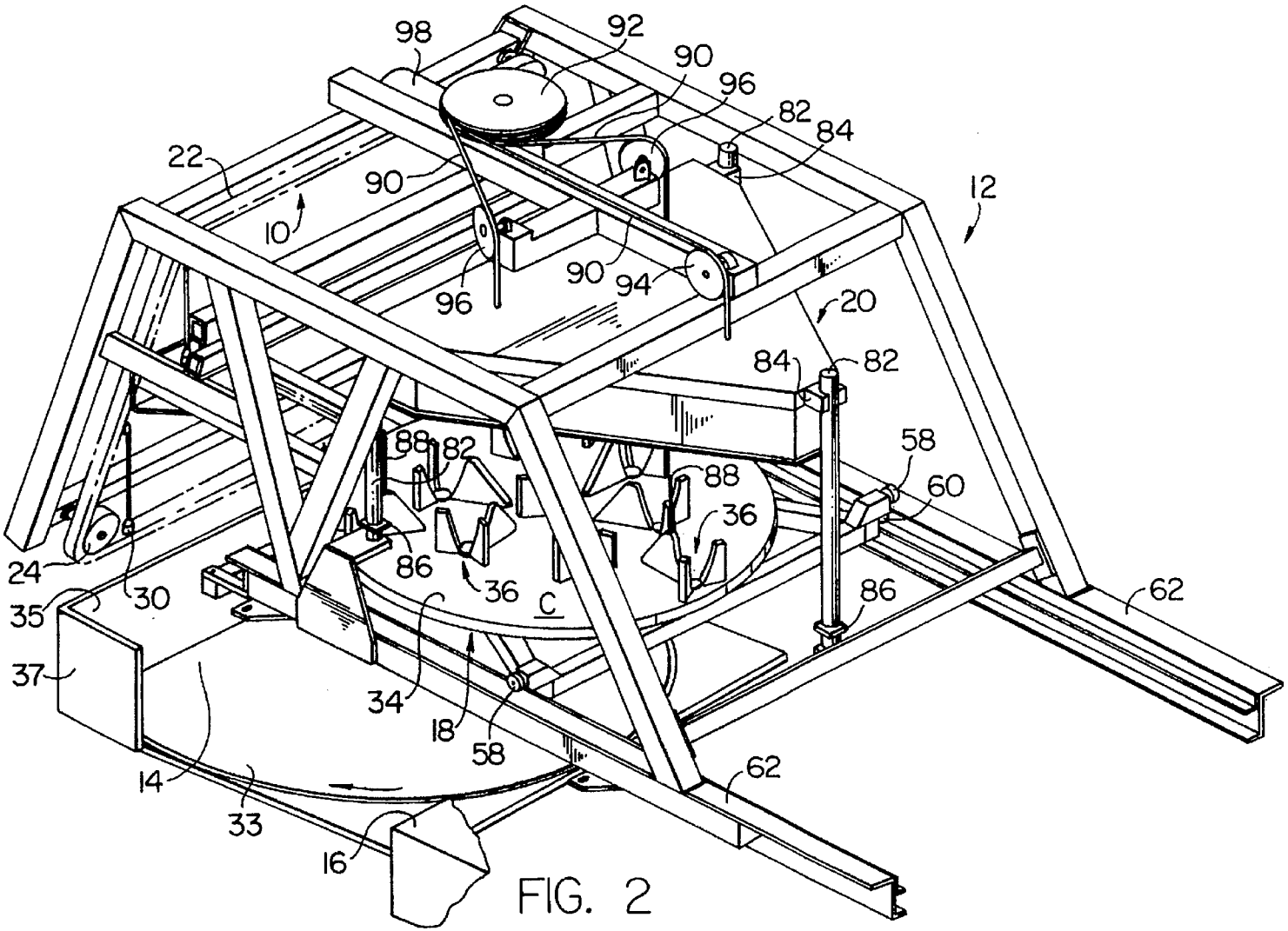
FIG. 2 is a further perspective view similar to FIG. 1 but showing a transfer mechanism in the pinsetter at a delivery station beneath a pinsetting mechanism.

Referring particularly to FIG. 2, it will be observed that a rotary table 33 is provided in the pit area 14 adjacent the rear end portion of the bowling alley 16. The table 33 rotates in a clockwise direction in FIG. 2 and accepts bowling balls and fallen bowling pins from the rear end portion of the bowling alley 16. The table 33 has a slight downward inclination toward the left as viewed from the front in FIG.

2 whereby to cause bowling balls to roll leftwardly for a purpose to be described hereinbelow.

In its clockwise rotation, fallen bowling pins are carried rearwardly into engagement with a barrier means which serves to obstruct the movement of the pins on the table and to thus provide for collection of the pins and the establishment of the pin loading or pick-up station D. As best illustrated in FIG. 2, the barrier means takes the form of a vertical rear wall 35 which extends transversely over a rear portion of the table 33 and a short connected side wall 37 forming a corner with the wall 35. As will be apparent, the bowling pins tend to collect in the corner defined by the walls 35,37 and will reside in indiscriminate orientation in the corner at the loading or pick-up station D, FIG. 4. Preferably a number of additional or surplus pins are provided so that there will always be sufficient pins on the rotary table 33 for pick-up by the magnets 30,30 and for delivery of the same to the transfer mechanism 18, the pins thus being held in readiness in bowling array on the transfer mechanism for immediate delivery to the pinsetting mechanism when the rear end portion of the bowling alley has been cleared of bowling pins.

As best illustrated in FIGS. 3 and 4, the pin discharge station A is located above and in spaced relationship with the bowling alley. More particularly, the pin discharge station A resides beneath the upper horizontal run 28 of the conveyor 22 and above the transfer mechanism 18 and a rotary indexible table 34 which forms a part of the transfer mechanism. The table 34 is provided with a plurality of upwardly open cradles 36,36 for receiving and holding bowling pins in upright attitude. When the desired bowling array comprises ten (10) bowling pins in a conventional triangular arrangement, ten (10) cradles are, of course, provided as illustrated in conventional triangular arrangement, FIGS. 5 and 6.

Reverting now to the pin discharge station A, at least one gate 38 is provided at the station and is operable to cause bowling pins to be discharged from the conveyor 22 to the transfer mechanism 18 and, more specifically, to the cradles 36,36 on the rotary table 34. When ten (10) pins and cradles are provided as in FIGS. 5 and 6, two (2) horizontally spaced apart gates 38,38 are provided adjacent and in alignment with the linear path of movement of the upper run 28 of the conveyor 22. Further, a fixed stop 40 is also preferably arranged above the center of the table 34. Both the gates 38,38 and the fixed stop 40 operate to disengage and thus discharge bowling pins from their carrying magnets 30,30 by obstructing the rightward movement thereof as the associated magnet continues to move and thereby causing the bowling pin to disengage and fall from its magnet into a cradle 36 positioned therebeneath.

Figure 7:
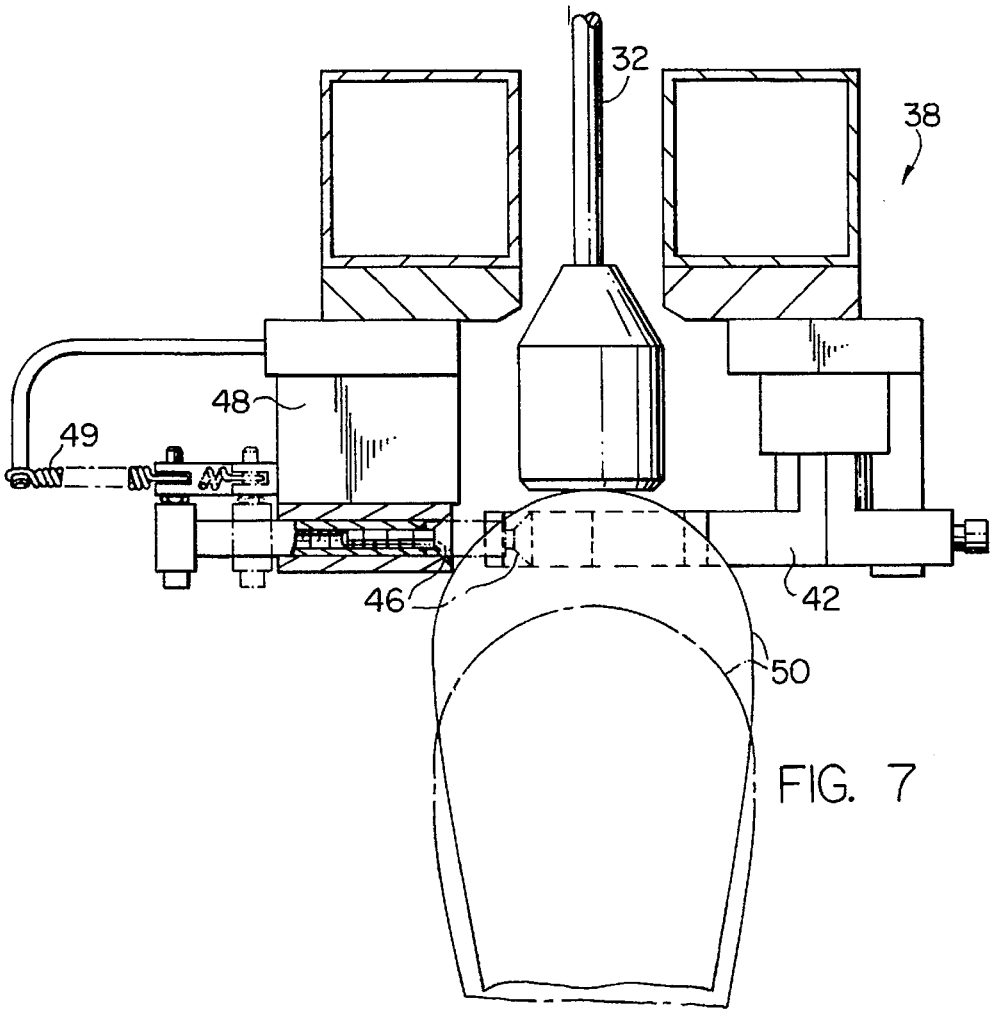
FIG. 7 is an enlarged fragmentary elevational view of a gate operable at a pin discharge station.
Figure 8:
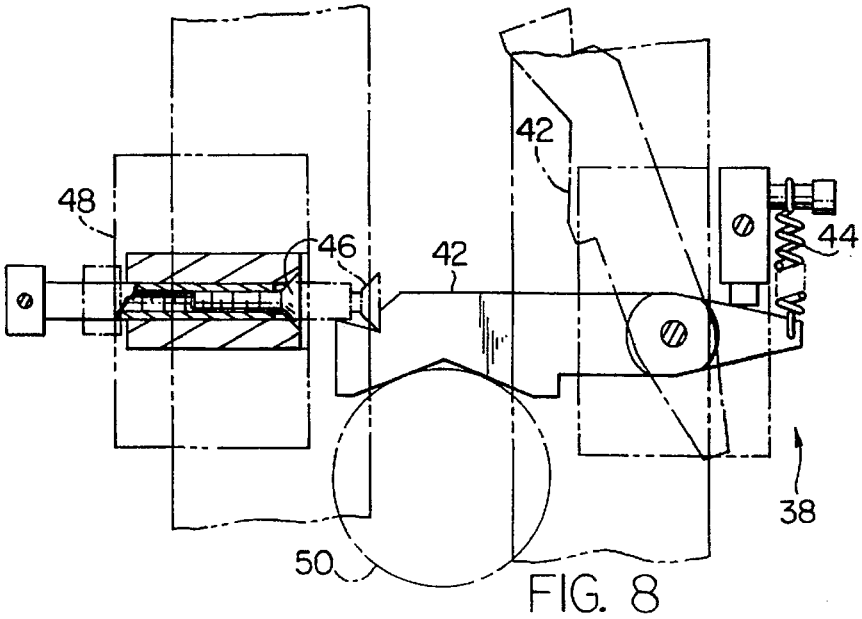
FIG. 8 is an enlarged top view of the gate of FIG. 7.

As best illustrated in FIGS. 7 and 8, a representative gate 38 has a swingable gate member 42 shown in operative or pin obstructing position in full line in FIG. 8 and in broken line at its inoperative or open position. A bias spring 44 urges the gate member 42 to its operative position for latching engagement by a plunger 46 shown in operative position in broken line and retracted or inoperative position in full line. The plunger 46 is operated by a solenoid 48 and a bias spring 49 so as to be moved to its broken line operative or latching position in FIG. 8 and to be retracted to its full line inoperative position in FIGS. 7 and 8. In its operative or latching position, a front end portion of the plunger 46 engages the gate member 42 and prevents the same from swinging open in a clockwise direction so as to accommodate the free passage of a bowling pin through the gate assembly 38.

Figure 5:
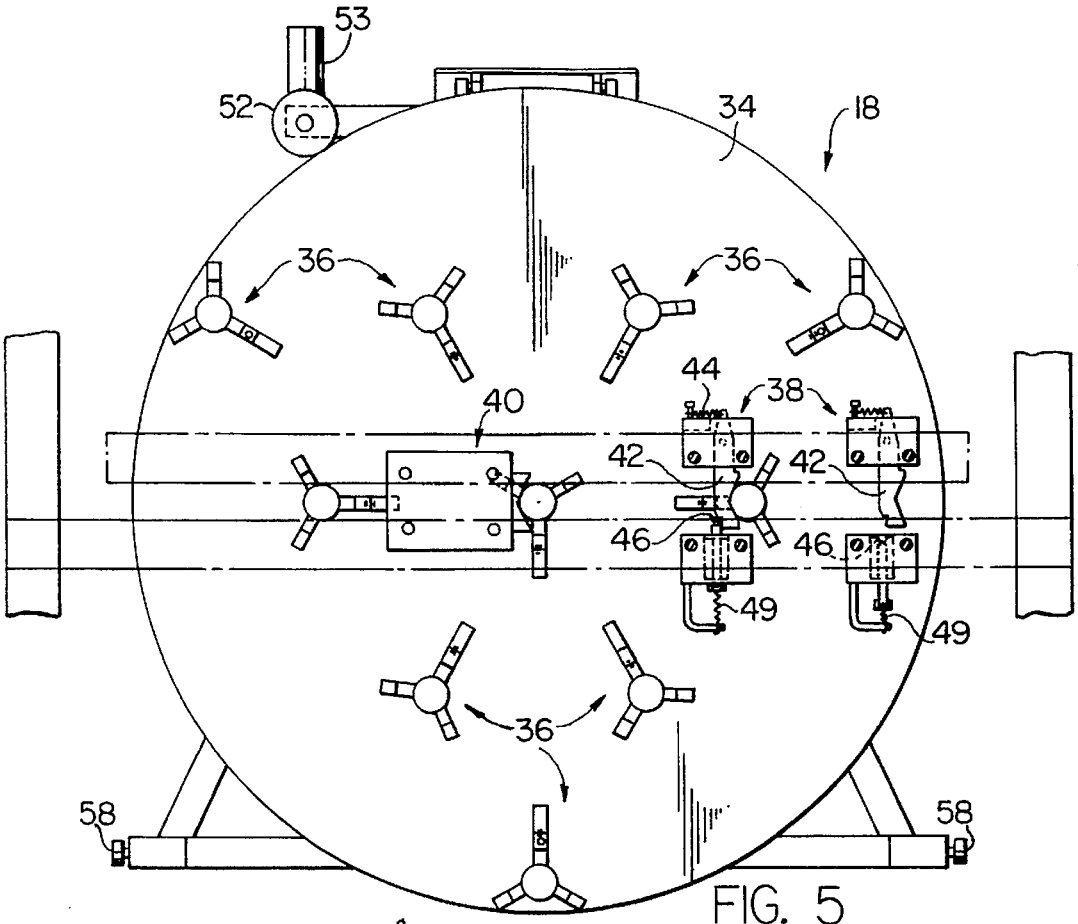
FIG. 5 is a top view of a rotary indexible table forming a part of a transfer mechanism of the present invention.
Figure 6:
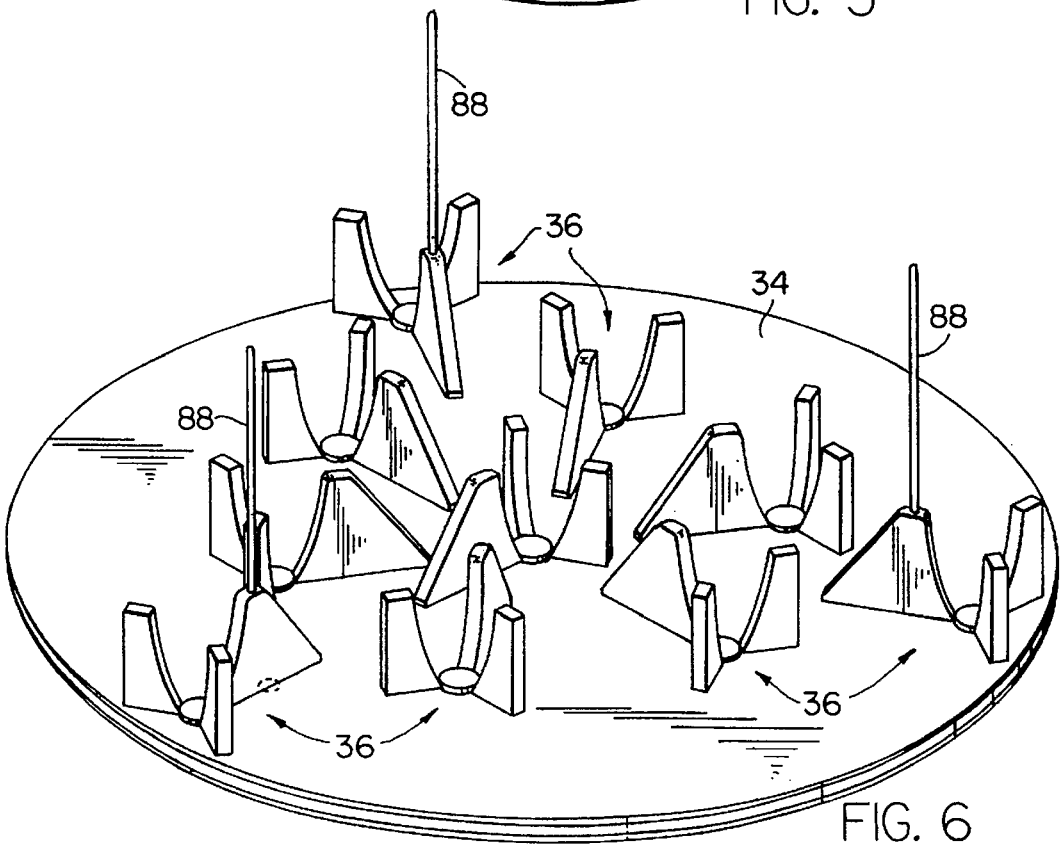
FIG. 6 is a perspective view of the rotary indexible table of the automatic pinsetter.

As will be apparent, the gates 38,38 and the indexible rotary table 34 can be readily operated in timed relationship so as to fill each of the cradles 36,36 on the table with a bowling pin. In FIG. 5 the rotary table 34 resides at an index position where a cradle 36 beneath the left-hand gate 38 is positioned so that a bowling pin can be disengaged from its magnet and dropped vertically into the cradle. Accordingly, the left-hand gate 38 in FIG. 5 is closed so as to engage the head of a bowling pin such as a pin 50 in FIG. 7 and to cause the same to disengage from its magnet 30 and fall into the cradle 36. On opening of the left-hand gate 38 and with the table 34 remaining in the FIG. 5 position, the next succeeding bowling pin 50 will engage the fixed stop 40 and thus be discharged into the center cradle 36 therebeneath.

Still referring to FIG. 5, it will be observed that the table 34 can next be indexed through thirty degrees (30°) in a clockwise direction whereby to bring an outermost cradle 36 at a rear right-hand corner of the triangular arrangement beneath the right-hand gate 38. With the gate 38 closed, the next succeeding bowling pin will engage the same, disengage from its magnet 30, and fall into the outermost cradle 36. A succeeding 30° clockwise indexing movement of the table 34 will bring the cradle 36 immediately to the left of the outermost cradle 36 in FIG. 5 to a loading position beneath the left-hand gate 38. Thus, in this index position of the table 34 the right-hand gate 38 is open and the left-hand gate 38 is closed, the next succeeding bowling pin engaging the left-hand gate 38 and falling into the cradle 36 therebeneath. The next indexing movement of the table 34 comprises a 60° clockwise movement whereby to bring the cradle 36 at approximately eleven o'clock in FIG. 5 beneath the left-hand gate 38. As will be apparent, all of the cradles 36,36 will be filled on completion of nine (9) indexing movements of the table 34, eight (8) thirty degree (30°) and one (1) sixty degree (60°) indexing movement, with an additional 60° movement to bring the number one pin to the front position.

Indexing movements of the table 34 may be provided by a small drive roller 52 engaging the periphery of the table and operated, for example, by a direct current electric motor 53.

Figure 9:
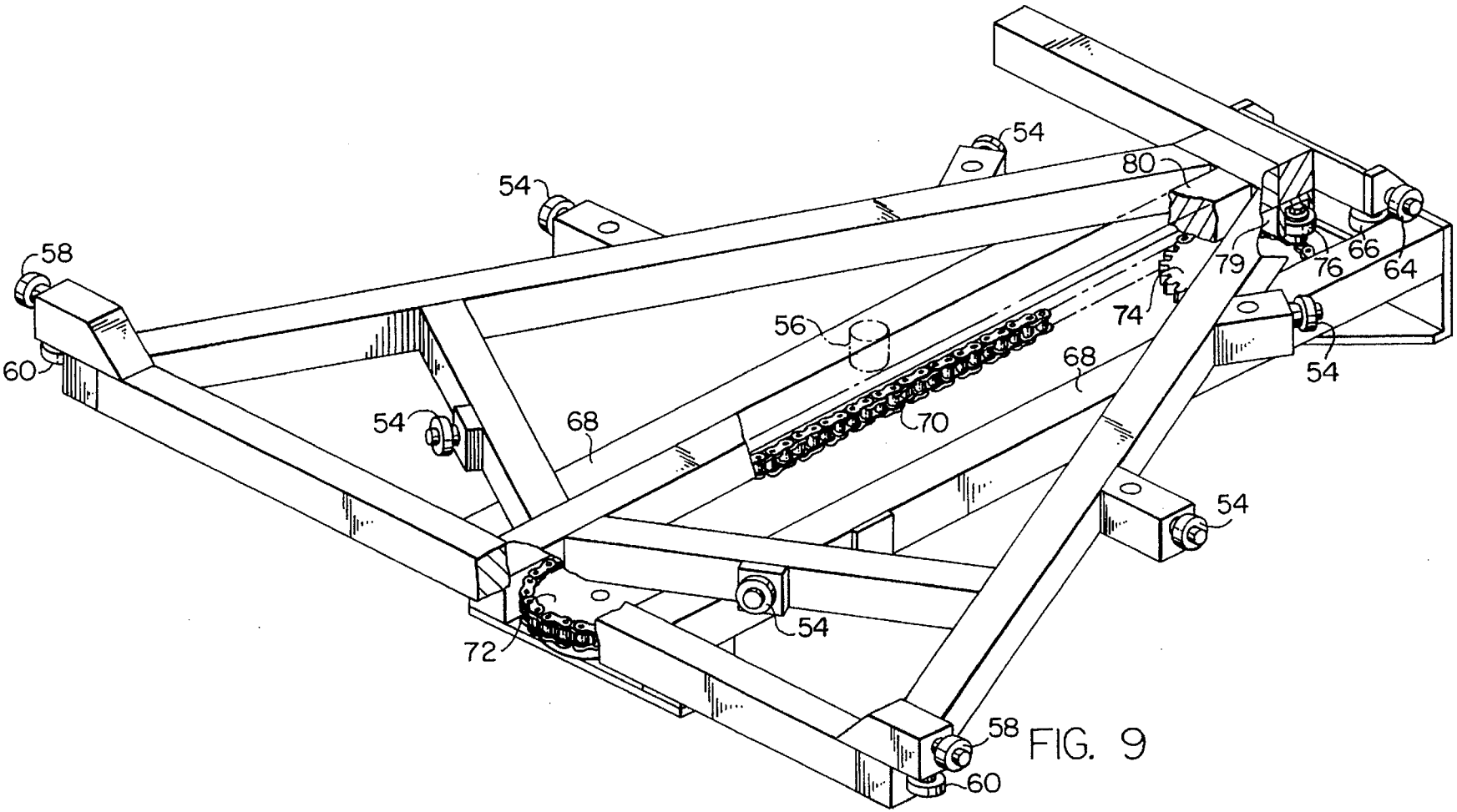
FIG. 9 is a perspective of a supporting structure for the rotary indexible table of FIGS. 5 and 6.

FIG. 9 illustrates a supporting structure for the table 34 which accommodates the rotary indexing movement thereof and which also provides for transfer of the table bodily between its loading station B and its delivery station C. As illustrated, a supporting framework is provided with a plurality of small support rollers 54,54 for the table 34 together with a central stub shaft 56 about which the table rotates in its indexing movements. The framework of the supporting structure is provided with its own rollers 58,60 arranged at right angles and at opposite front end portions thereof for movement in one and an opposite direction along parallel front to rear frame members 62,62, FIG. 2. At a rear end portion of the structure right angularly arranged rollers 64,66, FIG. 4, move in one and an opposite direction along parallel frame members 68,68 of the pinsetter, FIG. 9. A chain 70 has an idler sprocket 72 at a front end portion and a drive sprocket 74 at a rear end portion with a small connecting link 76 between the chain 70 and element 79 of the supporting structure. As will be apparent, a drive means such as a direct current electric motor, not shown, may be connected with the rear sprocket 74 to drive the sprocket chain 70 and thereby cause the table support frame and the table 34 to be moved from the loading station B to the delivery station C, FIG. 3. At the delivery station C the rotary table 34 is in precise vertical alignment with the desired location of the bowling array on the bowling alley 16 therebeneath. Further, the pinsetting mechanism 20 is moveable vertically in precise vertical alignment with the table 34 and the desired location of the bowling array on the bowling alley, an uppermost position of the pinsetting mechanism being above and in spaced relationship with the delivery station C, FIG. 2.

As best illustrated in FIGS. 1 and 2, the pinsetting mechanism 20 takes a generally triangular configuration viewed from above and is supported for vertical movement by three (3) vertically extending rods 82,82. That is, slide members 84,84 mounted on the pinsetting mechanism 20 and engaged with the rods 82,82 provide for the precise vertical sliding movement of the mechanism 20. Stops 86,86 on the slide rods 82,82 cooperate with the slide members 84,84 to establish a precise lowermost or discharge position of the pinsetting mechanism for depositing pins on the bowling alley 16. A first raised or intermediate position of the pinsetting mechanism above the rotary table 34 may be established by vertically extending stop members 88,88 on the table 34, FIGS. 2, and 6.

The pinsetting mechanism 20 also has a second raised position as illustrated in FIGS. 1, 2, and 3 above the table 34 when the latter is at its delivery station C. As will be apparent, bowling pins engaged and lifted from the cradles of the table 34 by the pinsetting mechanism at its intermediate position are held above the table during a return or rearward movement of the table to its loading station. The pinsetting mechanism may thereafter be lowered to its aforementioned lowermost position for deposit of the pins on the bowling alley.

The means for raising and lowering the pinsetting mechanism may vary widely within the scope of the invention but in the presently preferred form comprises a plurality of three (3) cables 90,90 operated by a drive pulley 92 and extending over idler pulleys 94 and 96. A single idler pulley 94 is disposed above a front end portion of the pinsetting mechanism 20 for attachment of a cable depending from the pulley to a front end portion of the mechanism. A pair of spaced pulleys 96,96, FIG. 1, are provided over the rear corner portions of the pinsetting mechanism 20 so that cables 90,90 can extend downwardly therefrom for attachment to the mechanism. Drive means for the pulley 92 may take the form of a direct current electric motor 98. As will be apparent, operation of the motor in one and an opposite direction will result in the required vertical movement of the pinsetting mechanism to and from the aforesaid positions.

Figure 10:
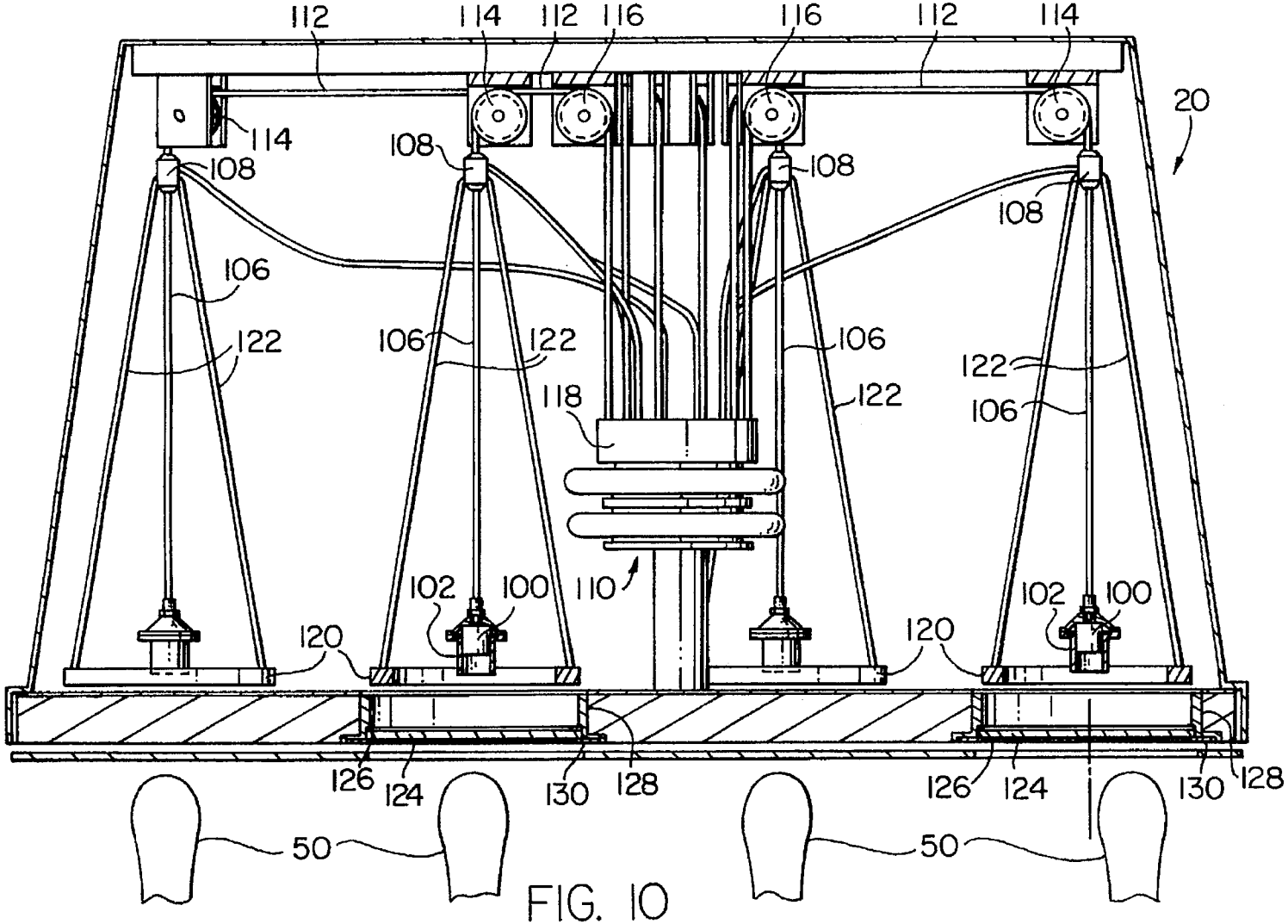
FIG. 10 is an enlarged sectional view in elevation of a first form of a pinsetting mechanism.
Figure 11:
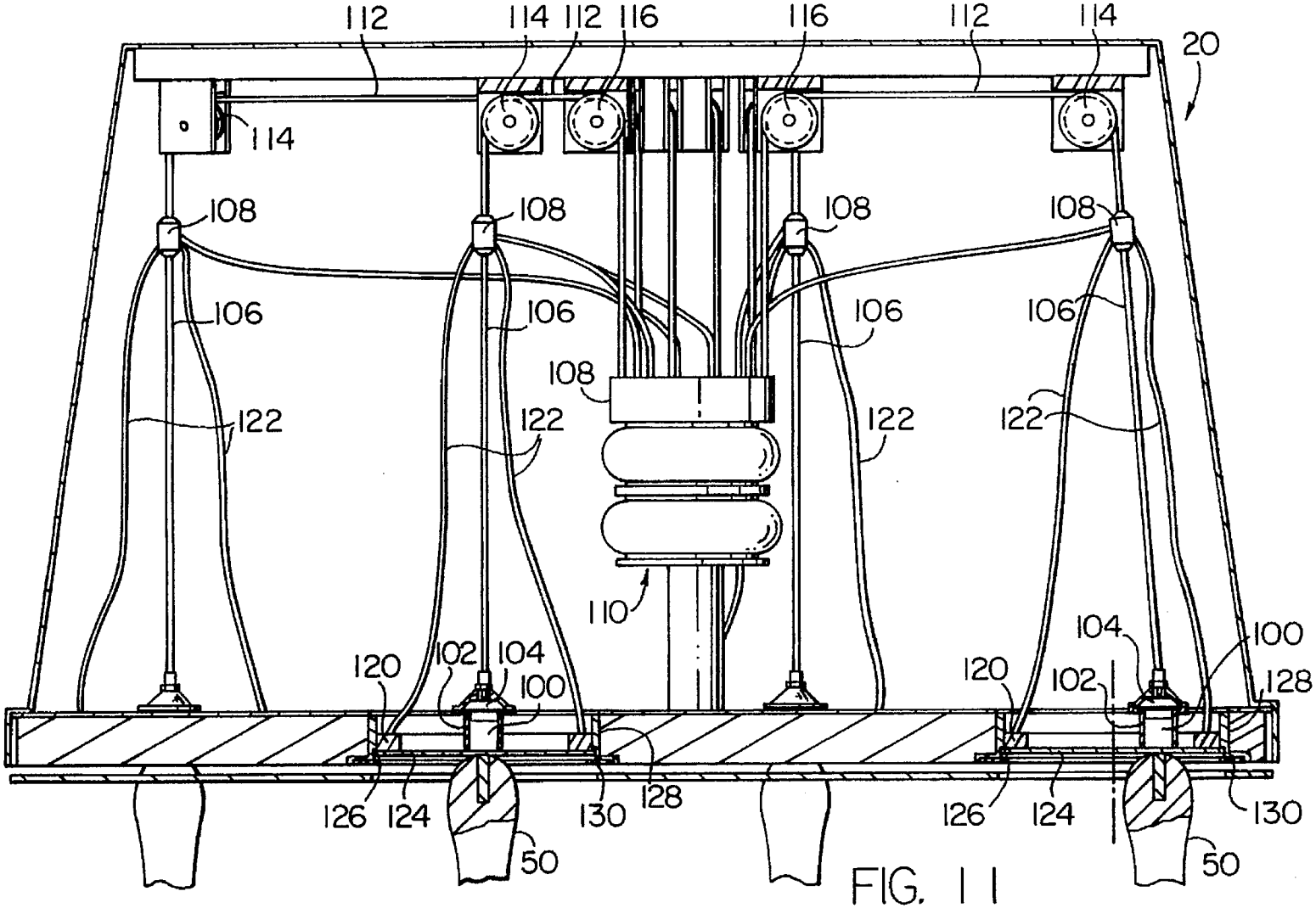
FIG. 11 is a view of the pinsetting mechanism of FIG. 10 but with the elements thereof in different operating positions.

In accordance with the present invention, the-pinsetting mechanism includes a plurality of magnets in substantially co-planner horizontal arrangement and in bowling array corresponding precisely with that of the cradles on the rotary table and the bowling alley therebeneath. When there are ten (10) bowling pins in conventional triangular arrangement, the pinsetting mechanism 20 includes ten (10) magnets in precisely the same arrangement with two (2) such magnets being illustrated at 100,100 in FIGS. 10 and 11. Each of the magnets 100 has a small casing 102 associated therewith which defines a vacuum chamber 104 thereabove and which has a vacuum line connected therewith and supporting the casing and the magnet. The vacuum lines 106,106 extend to small connector elements 108,108 and then, to an actuator 110. The actuator 110 serves both to selectively evacuate the chambers 104,104 and to raise and lower the connectors 108,108 whereby to raise and lower the casings 102,102 and their magnets 100,100. Extending upwardly from each connector 108 is a support line 112 which has associated pulleys 114 and 116 and which is connected to a manifold 118 at an upper end portion of the actuator 110. As will be apparent, the actuator 110 may be expanded as illustrated in FIG. 11 whereby to allow the support lines 112,112 to move upwardly at the manifold 118 and thus to allow the magnets 100,100 and casings 102,102 to move downwardly to the position shown in FIG. 11. On contraction of the actuator 110, as illustrated in FIG. 10, the lines 112,112 are drawn downwardly by the manifold 118 whereby to elevate the casings 102,102 and the magnets 100,100 as illustrated. As also illustrated in FIG. 10, the magnets 100,100 are moved upwardly within their casings 102,102 by evacuation of the chambers 104,104 in the casings. Evacuation is accomplished through the vacuum lines 106,106 and by operation of the actuator 110, a vacuum chamber within the manifold 118 connecting the lines 106,106 to a vacuum generator, not shown. The connectors 108,108 also carry annular weights 120,120 which are supported by a plurality of lines 122,122 extending therefrom to the connectors. The weights 120,120 serve as downward biasing means for separator means in the form of small plates 124,124. The plates 124,124 are arranged for limited vertical movement between the lower positions shown in FIG. 10 and the upper positions shown in FIG. 11. Shoulders 126,126 formed on annular support members 128,128 for the plates 124,124 limit the upward movement thereof. Downward movement of the plates is limited by annular members 130,130 therebeneath.

Referring again to FIGS. 10, 11, and 12, the operation of the pinsetting mechanism will be apparent. In FIG. 10, the pinsetting mechanism is moving downwardly above an array of bowling pins 50,50. Such movement may occur with pins on the rotary table 34, or with the pins on the bowling alley 16. The actuator 10 is in its contracted position with the magnets 100,100 raised within their casings 102,102. The biasing weights 120,120 are also elevated above the separator plates 124,124.

In FIG. 11, the pinsetting mechanism has descended to its pin engaging and pick-up position either above the rotary table 34 or the bowling alley 16. The heads of the bowling pins 50,50 are now in engagement with the separator plates 124,124 urging the plates upwardly and the weights 120,120 have descended to their biasing position atop the plates 124,124. In this position of the separator plates and weights, the plates serve to steady the bowling pins therebeneath prior to the full influence of the magnets on the heads of the pins. That is, when the magnets 100,100 and casings 102, 102 initially descend to the FIG. 11 position atop the separator plates, the magnets are at first retained in their upper positions as in FIG. 10. In their upper positions, the magnets may exert a limited degree of magnetic influence, short of their full influence, and will tend to "seek" the heads of bowling pins therebeneath and on the opposite sides of the separator plates. Thus, the right-hand bowling pin in FIG. 11 is displaced from the center of its separator plate 124 and may be said to be in an "off spot" position. That is, the pin may constitute a remaining upright pin after a first bowling ball has been released by a bowler with the pin having been jostled so as to be moved slightly from its spot on the bowling alley but with insufficient force exerted on the pin to topple the same. As will be apparent in FIG. 11, the associated magnet 100 and casing 102 move laterally from the center of the separator plate rather than causing the pin to tilt or otherwise displacing the pin as might occur if the full influence of the magnet were exerted immediately upon the pin. Thus, when the actuator 110 has completed its movement and has released the vacuum in the chamber 104 of the casing 102, the magnet 100 descends to the FIG. 11 position now exerting its full influence on the "off spot" bowling pin 50 therebeneath and, on subsequent elevation of the pinsetting mechanism the magnet raises the pin in-the "off spot" position.

When fallen bowling pins have been subsequently cleared from the bowling alley therebeneath, the pinsetting mechanism may again be lowered to its lowermost or discharge position whereupon the right-hand pin 50 will be deposited on the bowling alley in precisely the same "off spot" position occupied prior to raising of the same. As will be seen, the sequential operation of the actuator in first lowering the magnets and casing with the magnets elevated within the casings by evacuation of the chambers in the casings, followed by the downward release of the magnets is important in the efficient handling of "off spot" bowling pins. Operation is identical for the magnet and casing second from the left in FIG. 11 but with the bowling pin remaining centered or on "spot" the magnet merely drops vertically within its casing to exert its full influence on the bowling pin. There is no "seeking" operation necessary during the instantaneous upward retention of the magnet in its casing.

It will also be apparent from the foregoing that a similar result can be achieved without the use of vacuum generating means and the vertical sliding movement of magnets 100, 100 in their casings 102,102. Merely by employing a very slow increment of final downward movement of the magnets or, perhaps an instantaneous stop and go movement of the magnets in close proximity to the separator plates, the magnets can be caused to "seek" the head of an "off spot" bowling pin prior to engagement with the separator plates and thus avoid tilting or otherwise displacing such bowling pins.

The foregoing operation may, of course, occur in elevating a full complement of ten (10) bowling pins above a table 34 at its delivery station and thereafter depositing the pins on the bowling alley. Similarly, when a first ball has been thrown by a bowler, and when one or more bowling pins remain upright, the pinsetting mechanism may be lowered to its lowermost position whereupon the heads of such remaining pins will be engaged as illustrated in FIG. 11, gripped and held magnetically for elevation of the same by subsequent upward movement of the pinsetting mechanism. Upon clearing of the bowling alley of fallen bowling pins, the pins may be deposited or reset on the bowling alley and as explained, precise resetting of the pins will be achieved.

The release of bowling pins by the magnets 100,100 may also be accomplished by a variety of other means for causing limited vertical movement of the magnets relative to the heads of the pins and the separator plates 124,124. That is, the magnets 100,100 and their casings 102,102 may be elevated by the lines 106,106 whereby to cause the separator plates to engage the shoulders 126,126, thus limiting upward movement of the separator plates and, on continued upward movement of the magnets and casings, first reducing and then eliminating the influence of the magnets on the heads of the bowling pins. It should also be noted that the separation and release of the bowling pins can be accomplished by a judicious combination of physical movement of the magnets by the lines 106,106 and evacuation of the chambers 104,104 in the magnet casings 102,102. That is, the actuator 110 and its associated vacuum generator may be operated to evacuate the chambers 104,104, whereby to raise the magnets 100,100 within their casings absent upward movement of the lines 106,106. On elevation of the magnets 100,100 within the casings 102,102 and on reduction of the magnetic influence thereof with respect to the heads of the bowling pins 50,50, the pinsetting mechanism 20 may be elevated with the pins released and deposited therebeneath. Accordingly, raising the lines 106,106 alone, evacuating the chambers 104,104 alone, or a combination of both such actions may be employed in releasing bowling pins from the magnets 100,100.

FIGS. 13 through 16 illustrate the pinsetting mechanism and its magnet, separator means etc. in the presently preferred form. The aforementioned cables 90,90, are attached within pinsetting mechanism 20*a* to a frame member 132 first extending about small pulleys 134,134 mounted on a carrier 136 which is moveable vertically within the pinsetting mechanism. That is, the three (3) cables 90,90, one shown, have associated respectively therewith three (3) pulleys 134,134 arranged in horizontally spaced relationship within the pinsetting mechanism 20*a* and with the cables extending thereabout and fixedly connected to frame members, one shown, such as the member 132. Ten (10) magnet assemblies indicated generally at 138, one shown, are supported in common by the carrier 136 for vertical movement therewith relative thereto, and with the pinsetting mechanism 20*a*.

Each of the magnet assemblies 138 includes a small container 140 at least partially filled with a liquid 142 and containing a magnet 144 equipped with a float means 146. The container 140 is provided with a cover 148 and is slidable vertically within a sleeve 150. The sleeve 150 has an annular flange 152 at an upper end portion with biasing means in the form of one or more springs 154, one shown urging the flange and sleeve downwardly. Adjustment springs 156,156 are also operatively associated with the springs 154,154 in the embodiment shown. A separator plate 158 is provided beneath the container 140 and is engageable by the sleeve 150 at a lower end portion of the latter.

Figure 13:
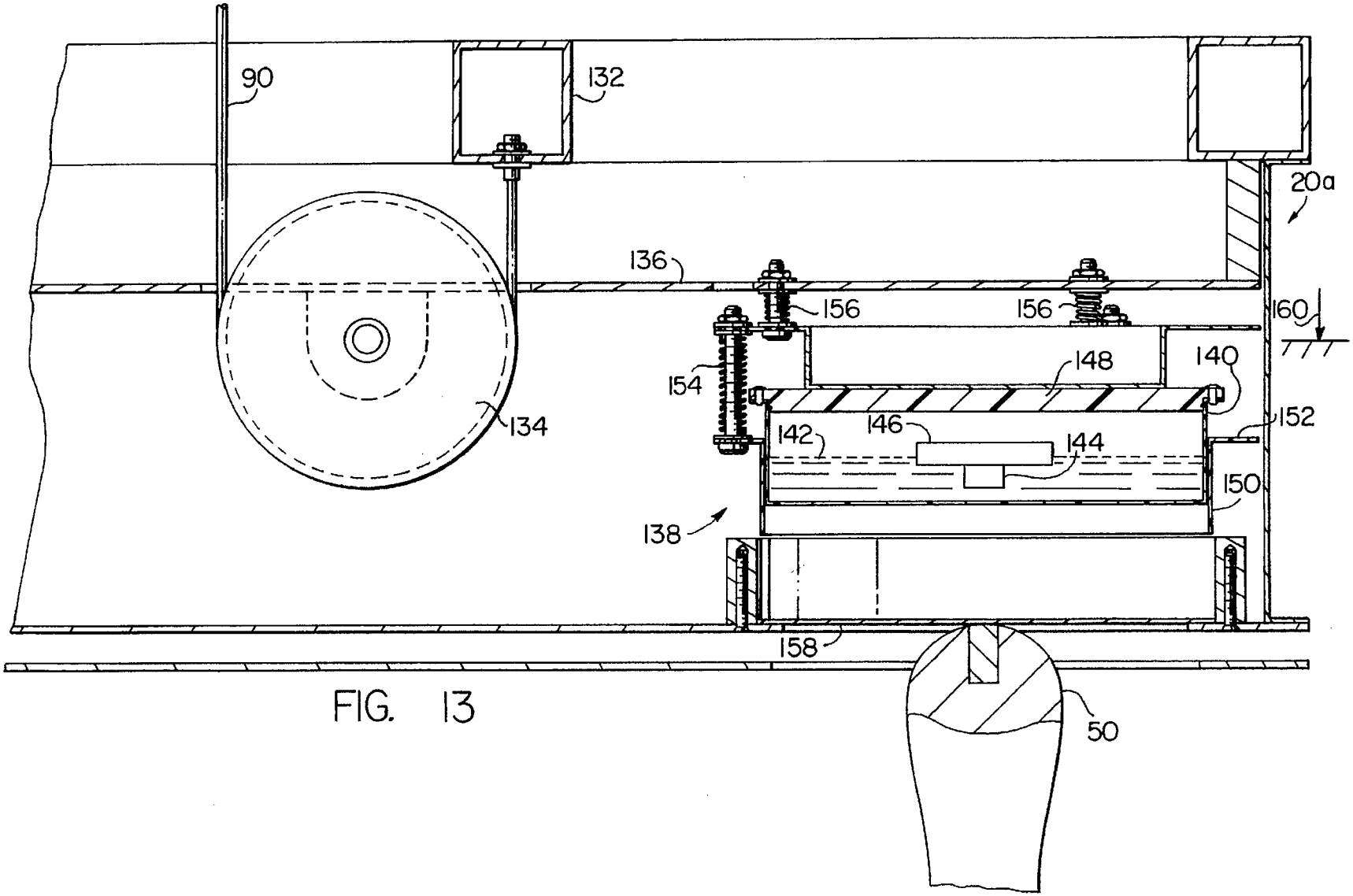
FIG. 13 is an enlarged fragmentary vertical sectional view of a portion of a second embodiment of a pinsetting mechanism of the present invention.
Figure 14:
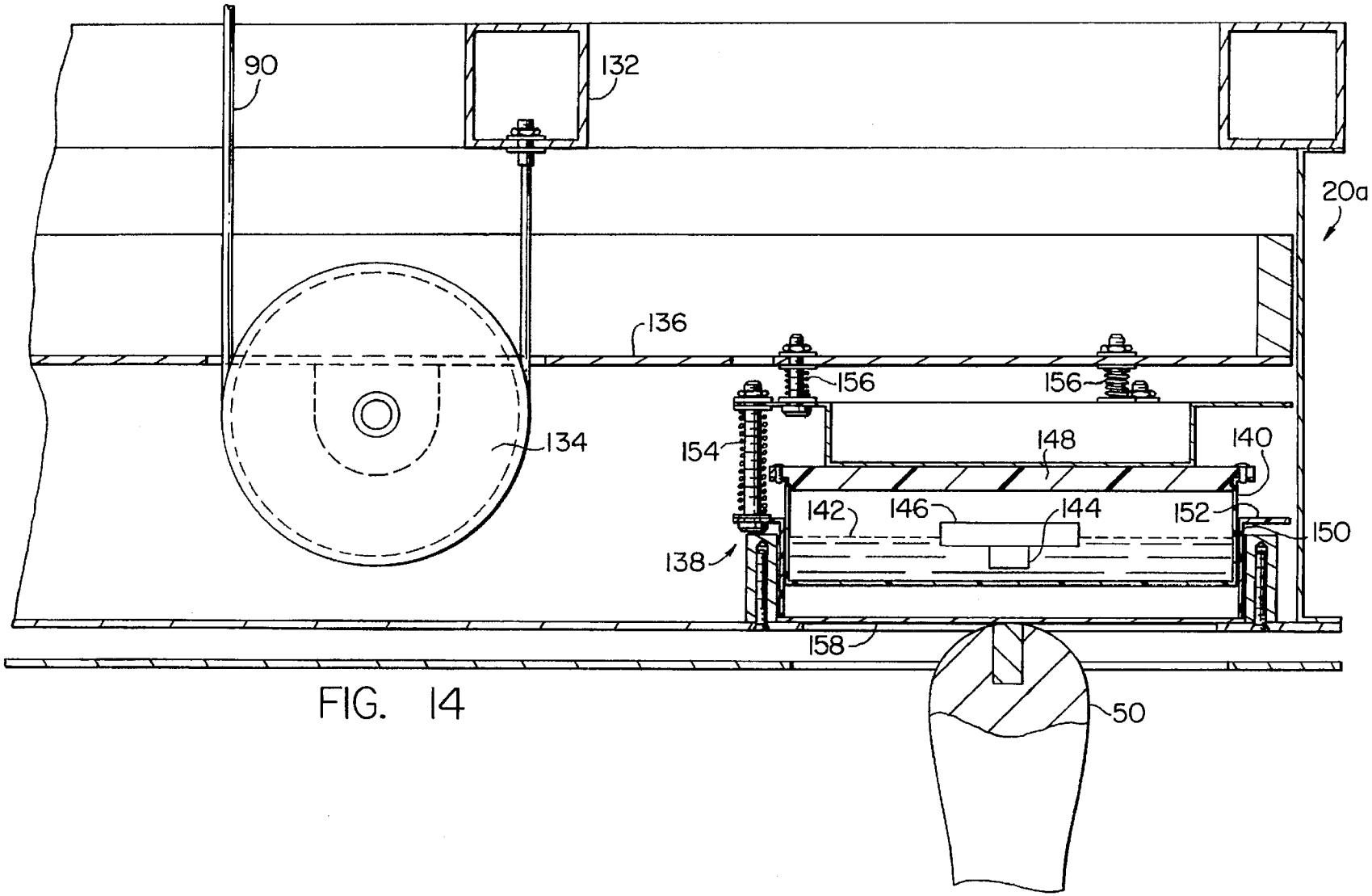
FIG. 14 is a view similar to FIG. 13 but with the elements of the pinsetting mechanism in a different operating position.
Figure 15:
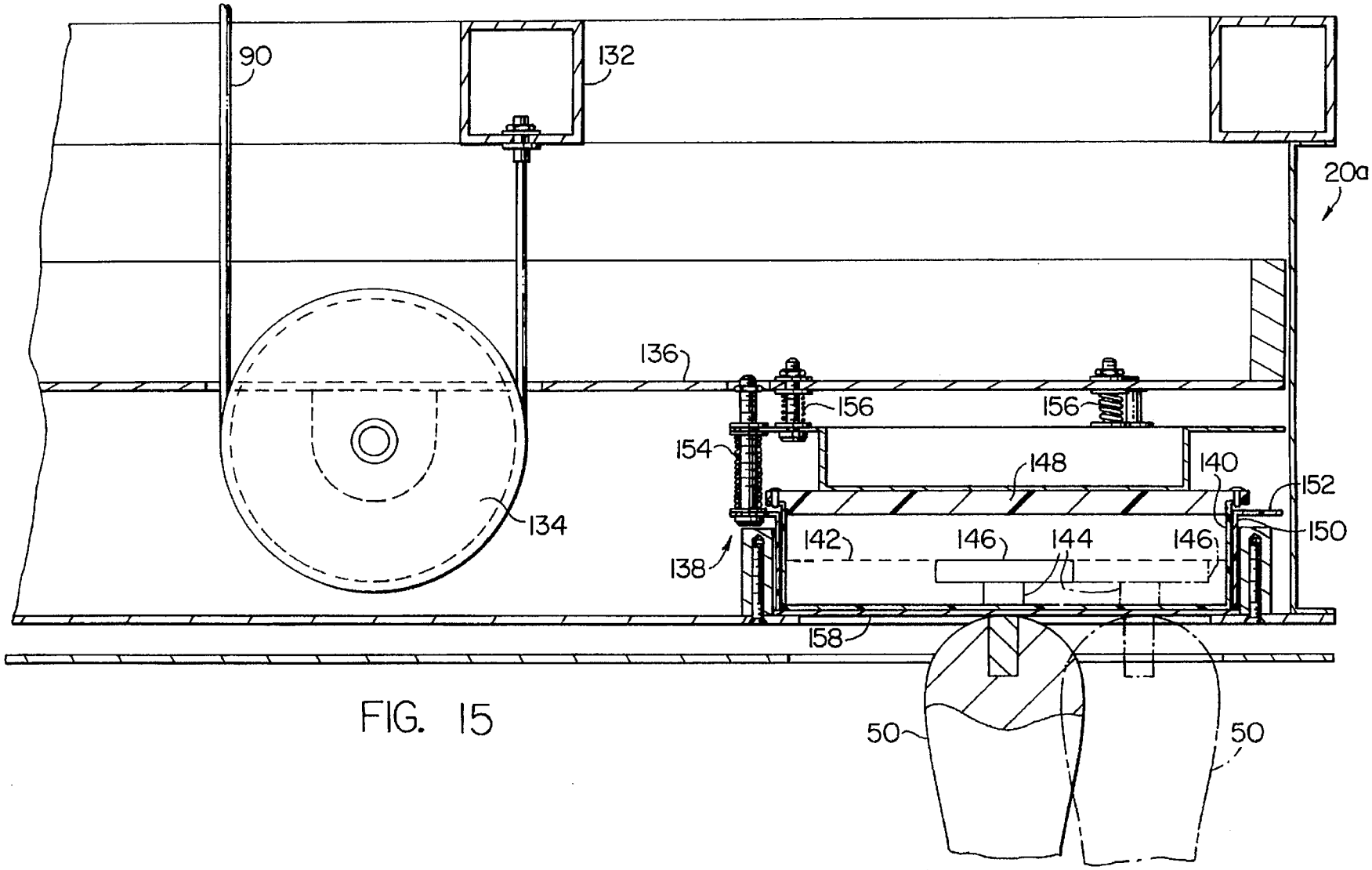
FIG. 15 is a view similar to FIG. 13 but with the elements of the pinsetting mechanism in a different operating position.
Figure 16:
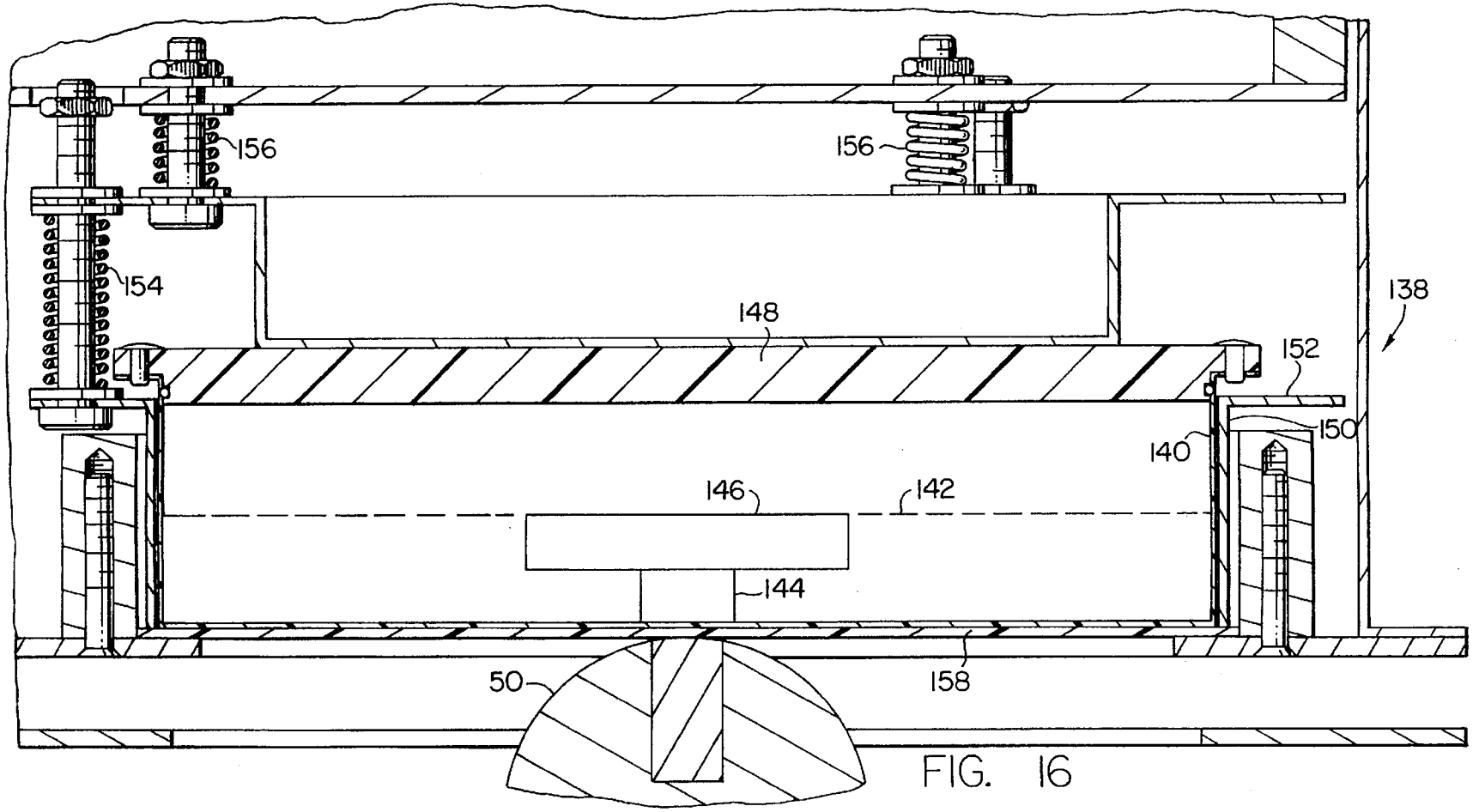
FIG. 16 is a further enlarged view of the mechanism of FIG. 15 with the elements in like position.

Referring now to FIG. 13, it may be assumed that the pinsetting mechanism 20*a* has reached a limit of downward travel as illustrated by the arrow 160. That is, the pinsetting mechanism may have reached a stop as described above in downward movement above the rotary table 34 or in downward movement above the bowling alley 16. Limited continued downward movement of the cables 90,90 will now allow the carrier 136 to move downwardly within the pinsetter carrying the magnet assemblies 138,138 therewith. Thus, magnet assembly 138 will operate as illustrated in FIGS. 13 and 14, with the head of a bowling pin 50 in engagement with the separator plate 158, an initial steadying operation of the separator plate on the bowling pin being thus achieved. In FIG. 14, container 140, in its downward movement within the sleeve 150, remains in spaced relationship above the separator plate 158 but the sleeve 150 resides in engagement with the separator plate and serves to bias the same downwardly at the urging of the biasing springs 154,154. On further downward movement of the carrier 136 and the magnet assembly 138 to the FIG. 15 position, the container 140 reaches the lower limit of its travel and engages the separator plate 158 as illustrated. The magnet 144 in the container thereupon moves downwardly overcoming the upward biasing force of its float 146 and engages the bottom of the container 140 whereby to magnetically grip and hold a bowling pin 50 beneath the separator plate 158. The bowling pin 50, shown in full line in FIG. 15, may be regarded as an "on spot" bowling pin whereas the bowling pin 50 shown in broken line may be regarded as an "off spot" bowling pin. Thus, when an "off spot" bowling pin is encountered, magnet 144 and float 146 will move laterally in the liquid 142 in the container 140 to a broken line position in FIG. 15 whereby to magnetically grip and hold a bowling pin therebeneath without tilting or otherwise displacing the pin. Partial magnetic attraction occurring in FIG. 14 prior to the FIG. 15 position causes the magnet and float to move laterally as stated. The further enlarged view of FIG. 16 illustrates elements in the FIG. 15 position but with an "on spot" bowling pin only.

On reverse movement of the cables 90,90 in the upward direction, the foregoing sequence is of course reversed with the magnet assemblies 138 being carried upwardly by the carrier 136. In FIG. 14, it will be noted that the sleeve 150 retains the separator plate 158 in its lowermost position while the magnet 144 has been moved sufficiently upwardly to release its magnetic hold on the bowling pin 50 therebeneath. Continued upward movement of the carrier thereafter returns the magnet assembly 138 to the FIG. 13 position whereupon the carrier 136 engages the frame members 132,132 and the entire pinsetting mechanism 20*a* is elevated as described.

Figure 18:
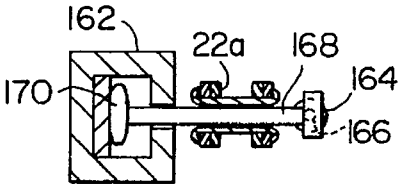
FIG. 18 is a sectional view taken generally as indicated at 18,18 in FIG. 17.
Figure 17:
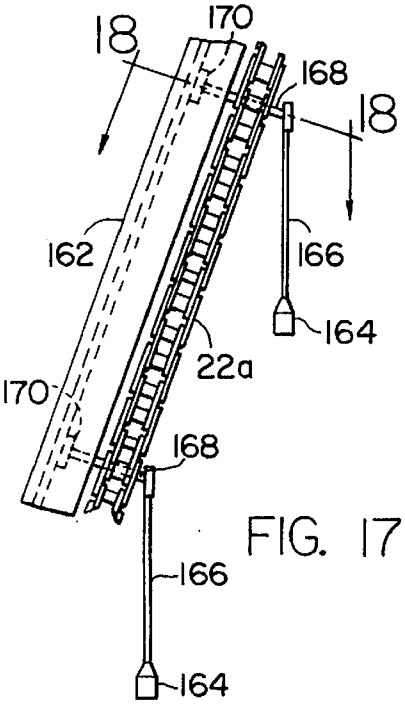
FIG. 17 is an enlarged fragmentary view of an alternative form of a conveyor employed in an elevator mechanism and incorporating electro-magnets.

The foregoing has dealt exclusively with the use of permanent magnets in the automatic pinsetter of the present invention but it will be obvious that electro-magnets can also be employed. FIGS. 17 and 18 illustrate the use of electro-magnets in the elevator mechanism of the present invention. Thus, a conveyor chain 22*a*, partially shown in FIG. 17, has an associated commutation track 162 which is also partially shown but which extends along and adjacent the conveyor chain throughout its length. Small electro-magnets 164,164 are suspended on flexible electrical conductors 166,166 from the chain 22*a*. Additional conductors 168,168 extend from the conveyor chain to the commutation track and may include T-shaped end portions 170,170 as illustrated in FIG. 18. With the T-shaped end portions 170,170 in sliding electrically conductive relationship in the commutation track 162 it will readily be understood that the electro-magnets 164,164 can be maintained in an energized state throughout their path of movement on the conveyor chain 22*a*. Construction and operation may be otherwise identical with the permanent magnet system described above.

Figure 12:
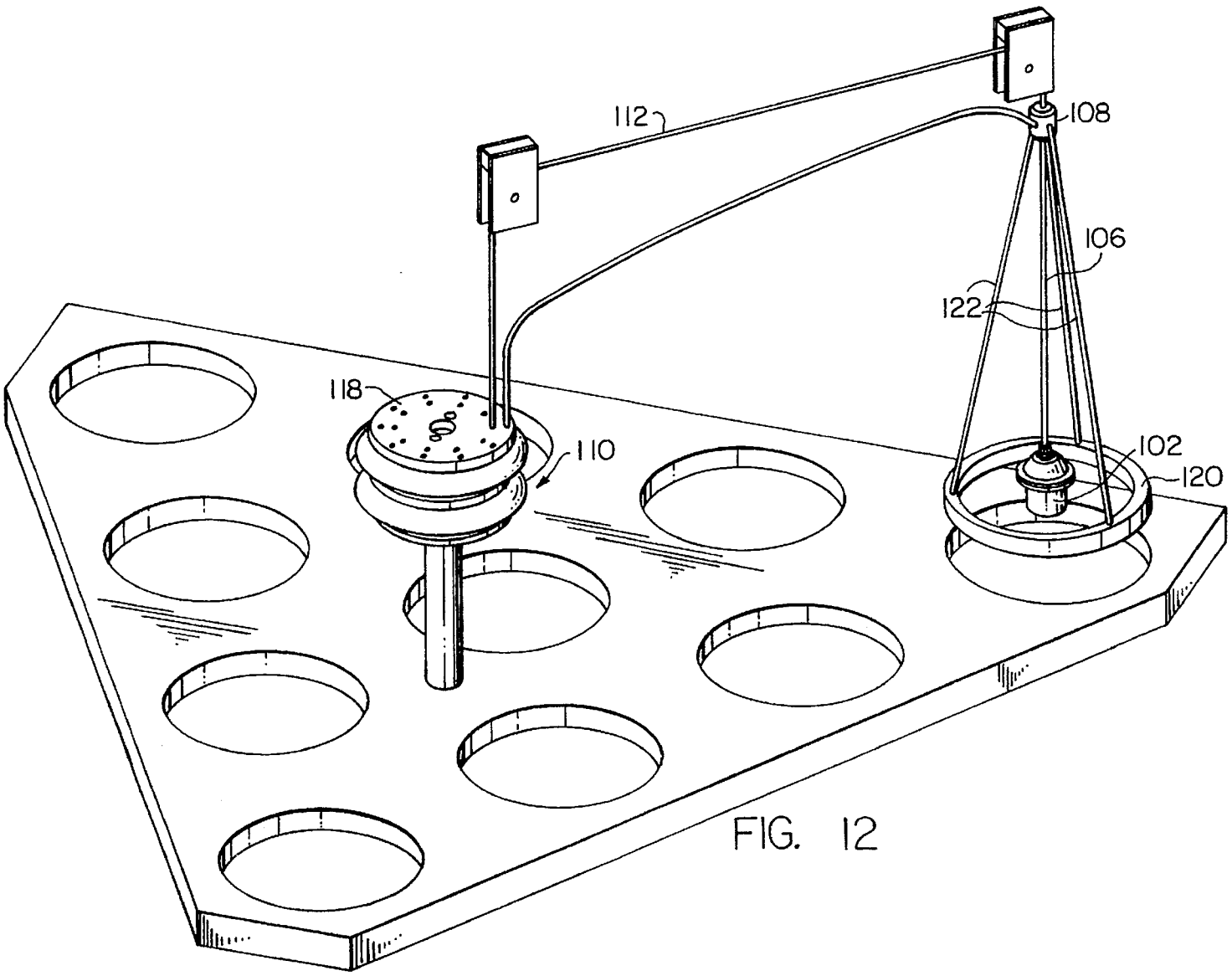
FIG. 12 is a perspective view of a portion of the pinsetting mechanism of FIGS. 10 and 11.
Figure 20:
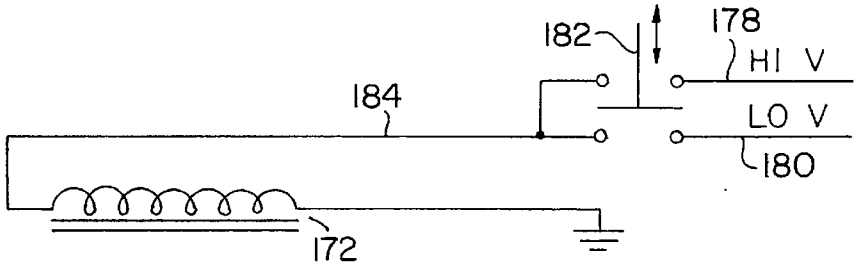
FIG. 20 is a schematic view of electrical connections for the electro-magnet of FIG. 19.
Figure 19:
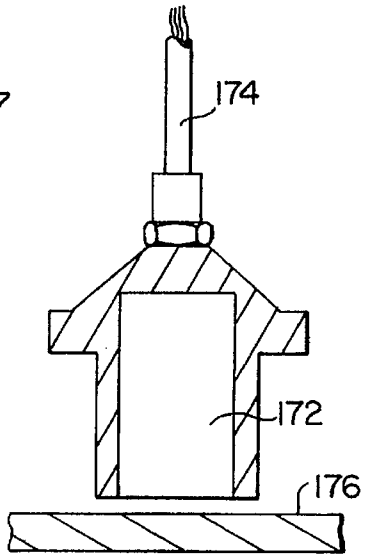
FIG. 19 is an enlarged fragmentary view of a single electro-magnet forming a still further embodiment of the magnet means in the pinsetting mechanism.

In FIG. 19, a small electro-magnet 172 is shown suspended from a flexible electrical conductor 174 in a pinsetting mechanism of the type illustrated in FIGS. 10 through 12. That is, vacuum lines 106,106 are replaced by flexible electrical conductors 174,174. Separator plates may be provided as at 176 in association with the magnets. As will be apparent, the magnets 172,172 may be energized and de-energized as required to magnetically grip and release magnetically responsive bowling pins. The electro-magnets 172,172 may be moved vertically in the manner described for the permanent magnets above or, the variable influence of the magnets causing them first to "seek" the head of a sub-adjacent bowling pin and thereafter to magnetically grip the same can be accomplished merely by selectively connecting the magnets to a high and low voltage source as illustrated in FIG. 20. Thus, a magnet 172 has an associated high voltage source 178 and a low voltage source 180 with a switch 182 operable to selectively connect the electro-magnet 172 through a line 184 with the two voltage sources. The switch 182 also operates to disconnect the electro-magnet from both voltage sources as illustrated at an intermediate position. Thus, the magnet may be energized at low voltage to provide a low level of magnetic influence over the sub-adjacent bowling pin whereby to cause the magnet to "seek" the head of the pin. Thereafter, when the magnet is energized at the higher voltage level, the magnet will of course serve to magnetically grip and hold the bowling pin. The foregoing may obviously be accomplished absent significant vertical movement of the magnet. The simple switching operation may of course be accomplished by a conventional controller associated with the automatic pinsetter.

Figure 21:
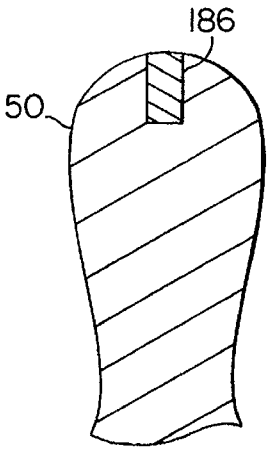
FIG. 21 is an enlarged fragmentary view of a head portion of a bowling pin showing a permanent magnet embedded therein.

The manner in which a conventional bowling pin is rendered magnetically responsive may also vary widely in accordance with the present invention. As best illustrated in FIG. 21 a small permanent magnet 186 may be embedded in an upper end portion or head of a magnet 150 and the magnet may be of the recently developed anodyne type. A variety of other types of small powerful magnets, may of course, also be employed.

Figure 22:
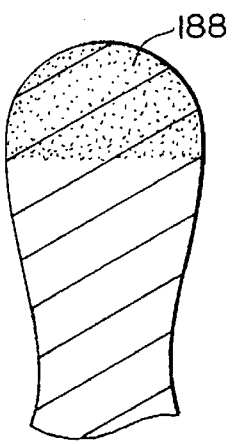
FIG. 22 is a view similar to FIG. 21 but showing an alternative form of magnetic means in the head of a bowling pin.

As illustrated in FIG. 22 it is also possible to provide magnetically responsive bowling pins by providing a multiplicity of small particles 188,188 of magnetic material dispersed throughout an upper end portion of a bowling pin. The magnetic particles may for example be dispersed in a resin of which the bowling pin is formed.

A sweeper mechanism for removing fallen bowling pins from the bowling alley is or may be conventional and as best illustrated in FIGS. 1 and 3, a sweeper element is provided at 190 and is pivotally mounted on a conveyor chain 192, partially shown in FIG. 1. The sweeper element is moved in one and an opposite direction by reversing movement of the conveyor chain whereby to sweep fallen bowling pins from the bowling alley rearwardly onto the table 33 and to return to its start position. At the start position a small cam member 194 causes the sweeper element 190 to swing upwardly so as not to interfere with bowling balls in progress down the bowling alley.

Figure 23:
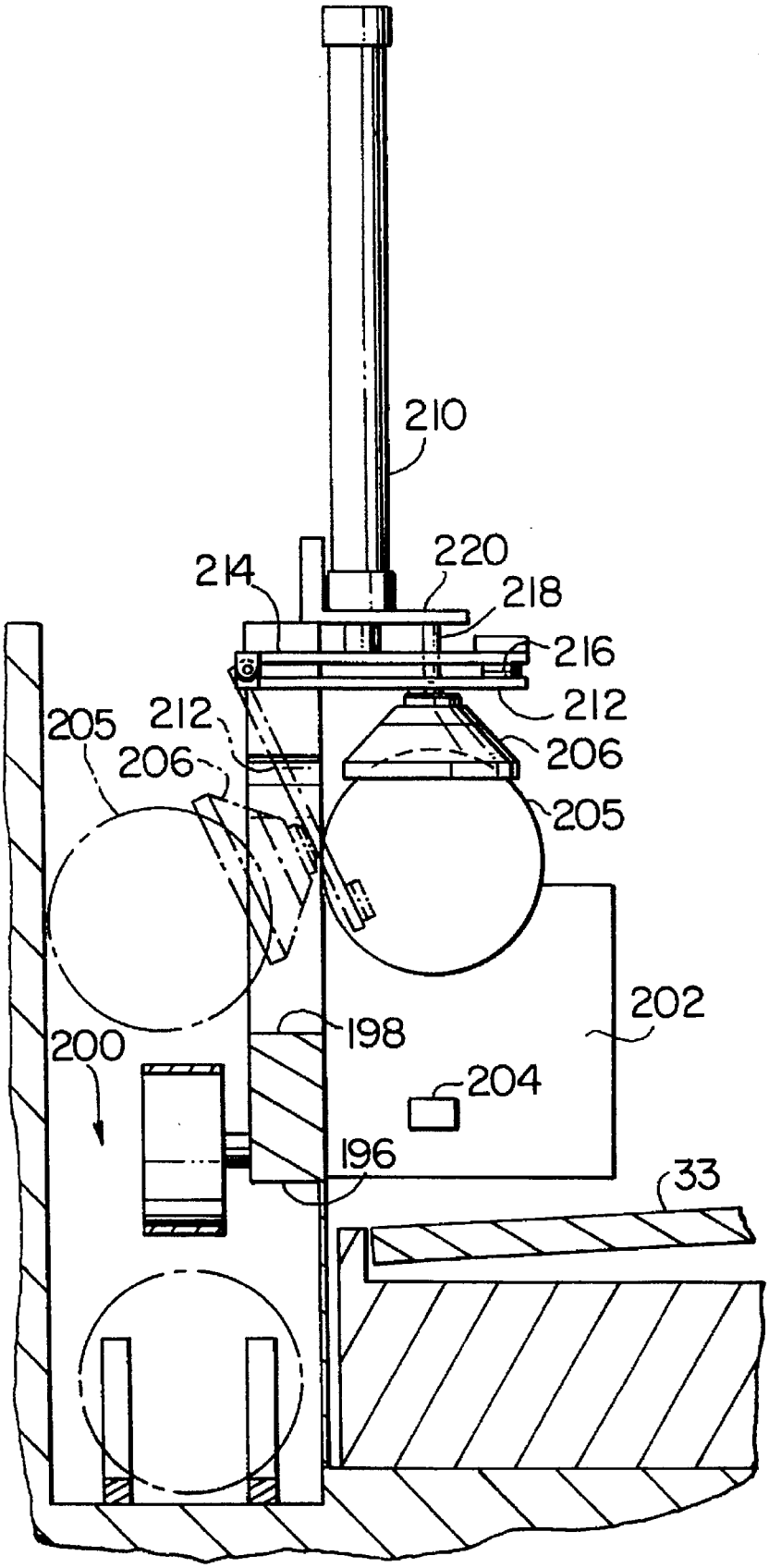
FIG. 23 is a vertical section taken through an improved bowling ball retrieval apparatus.
Figure 24:
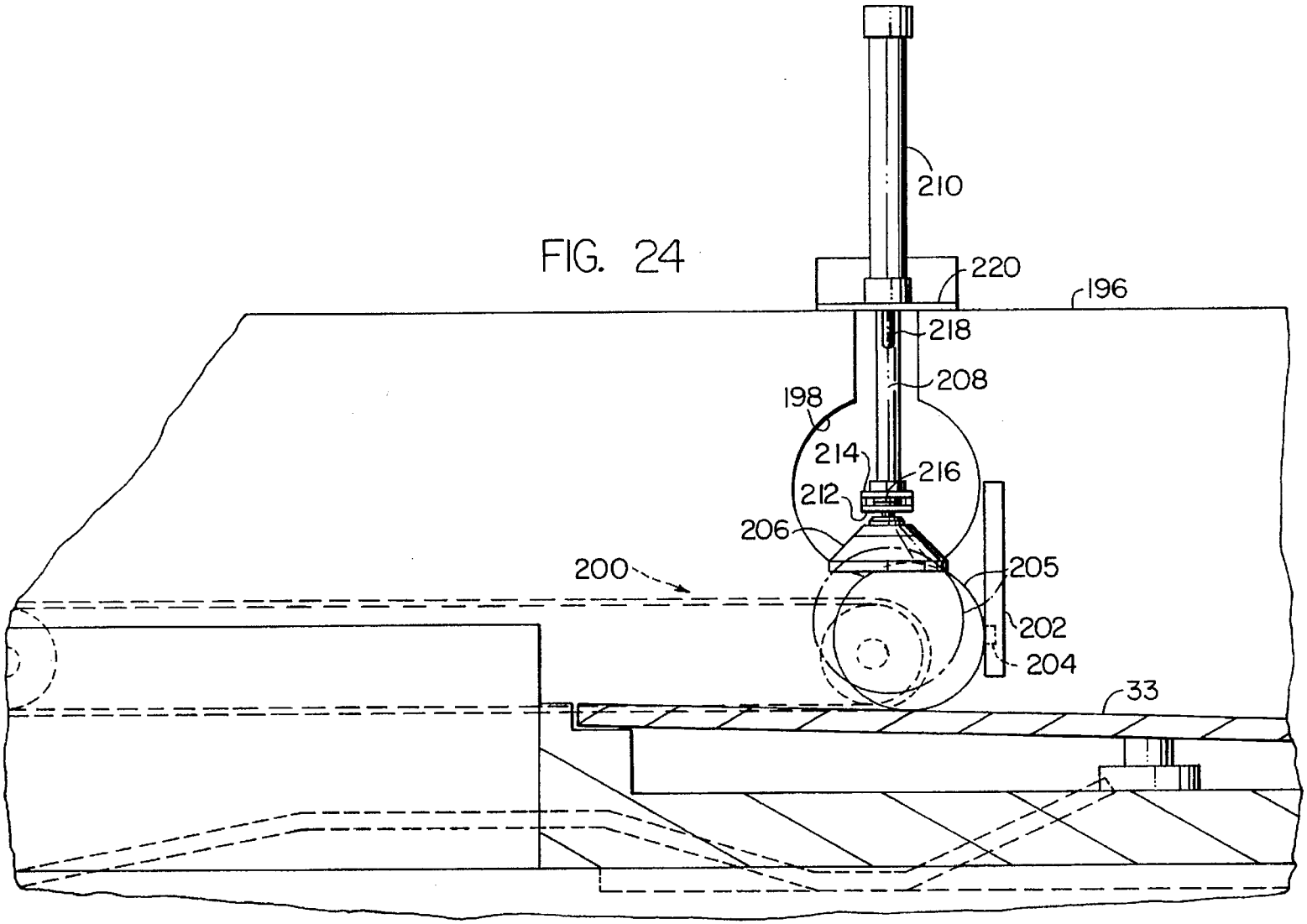
FIG. 24 is a vertical section of the bowling ball retrieval apparatus FIG. 23 taken at right angles to the FIG. 22 view.
Figure 25:
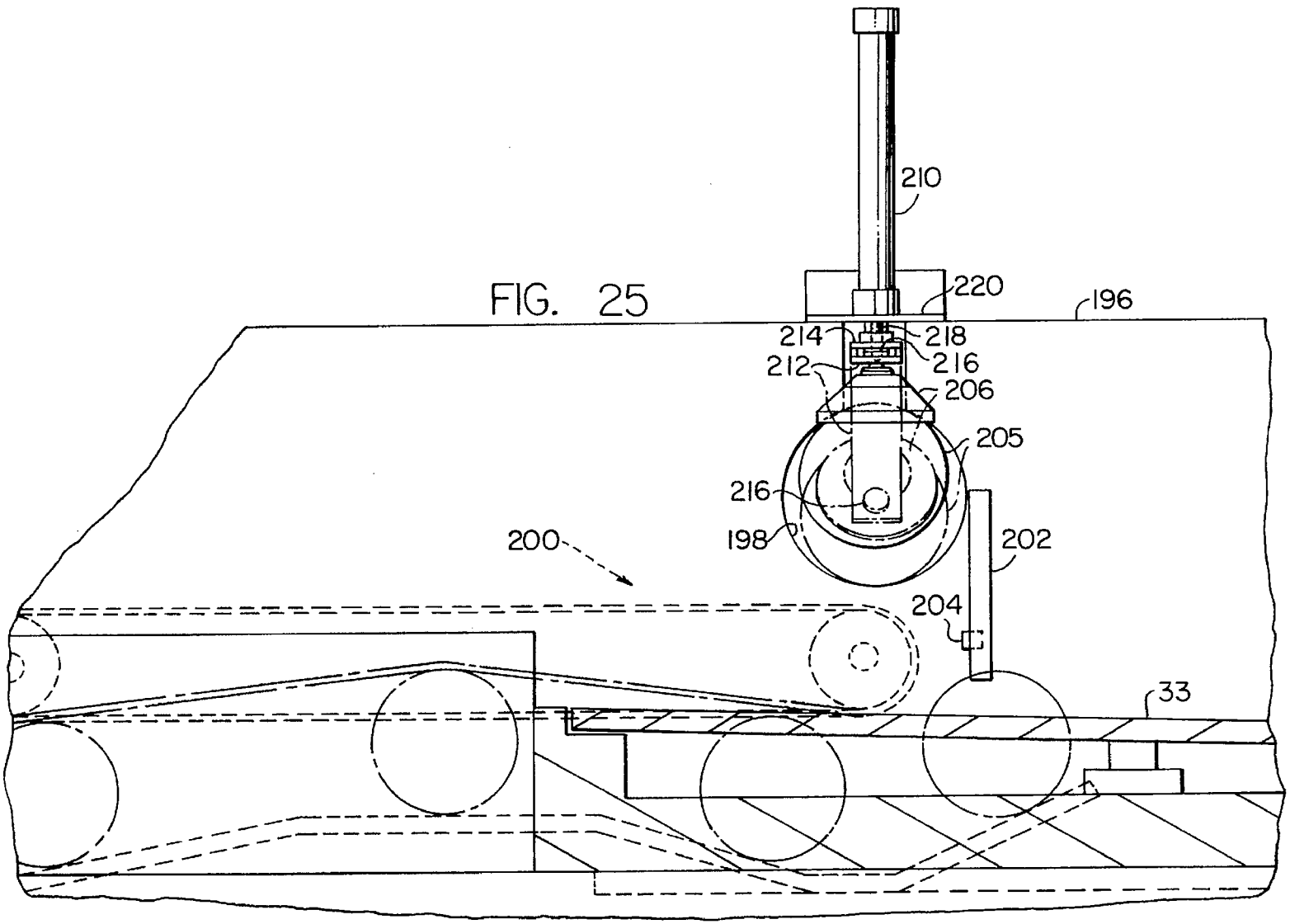
FIG. 25 is a further view similar to FIG. 24 but showing the elements of the ball retrieval apparatus in a further operating position.

The automatic pinsetter of the present invention may also include an improved bowling ball retrieval apparatus for gripping bowling balls and for holding the same during transport. FIGS. 23, 24 and 25 illustrate the ball retrieval apparatus adjacent a side wall or "kickback" 196 having an opening 198 therethrough. The opening 198 accommodates the passage of a bowling ball outwardly therethrough for deposit on a ball return mechanism indicated generally at 200, the latter being conventional. As best illustrated in FIG. 23 a bowling ball on the aforementioned rotary table 33, due to the slight leftward inclination of the table moves to a position adjacent a back-up plate 202 having an associated switch 204. The plate 202 holds the ball in a corner defined between the plate and the kickback 196. Thus, a bowling ball such as the ball 205 in FIGS. 24 and 25 is accurately positioned beneath a suction cup 206 carried by a vertically moveable rod 208. Rod 208 is operated by a fluid cylinder 210 and a swingable arm 212 is carried by the rod 208 and has an associated horizontally extending fixed arm 214. As best illustrated in FIG. 23, the arm 214 carries a small magnet at an end portion thereof at 216 and the magnet serves to secure the swingable arm 212 in the horizontal position shown in full line in FIG. 23. An actuating or release pin 218 mounted on a frame part 220 and projecting downwardly through an opening in the arm 214 engages the arm 212 when it reaches the uppermost position illustrated in FIG. 23. Thus, the arm 212 is urged downwardly to break the magnetic holding force exerted by the magnet 216 and the arm and ball swing at the urging of gravity downwardly and leftwardly in FIG. 23 whereby to transport the bowling ball 205 outwardly through the opening 198 for deposit on the ball return mechanism 200.

As will be apparent, the switch 204 can be employed in operating a vacuum generating means, not shown, for the creation of a vacuum within the suction cup 206 and also for the actuation of the fluid cylinder 210 in the raising and lowering of the cup 206 and the arms 212 and 214. Preferably the suction cup 206 is provided with a plurality of compartments with each compartment connected with the vacuum generating means individually. Thus, even though there may be only a small percentage of the compartments engaging and gripping the bowling ball, the gripping action is nevertheless sufficient to hold the ball, finger holes in the ball thus being readily accommodated. Preferably there are between nine and fifteen compartments in the suction cup with twelve compartments being provided in the cup 206 shown.

Figure 27:
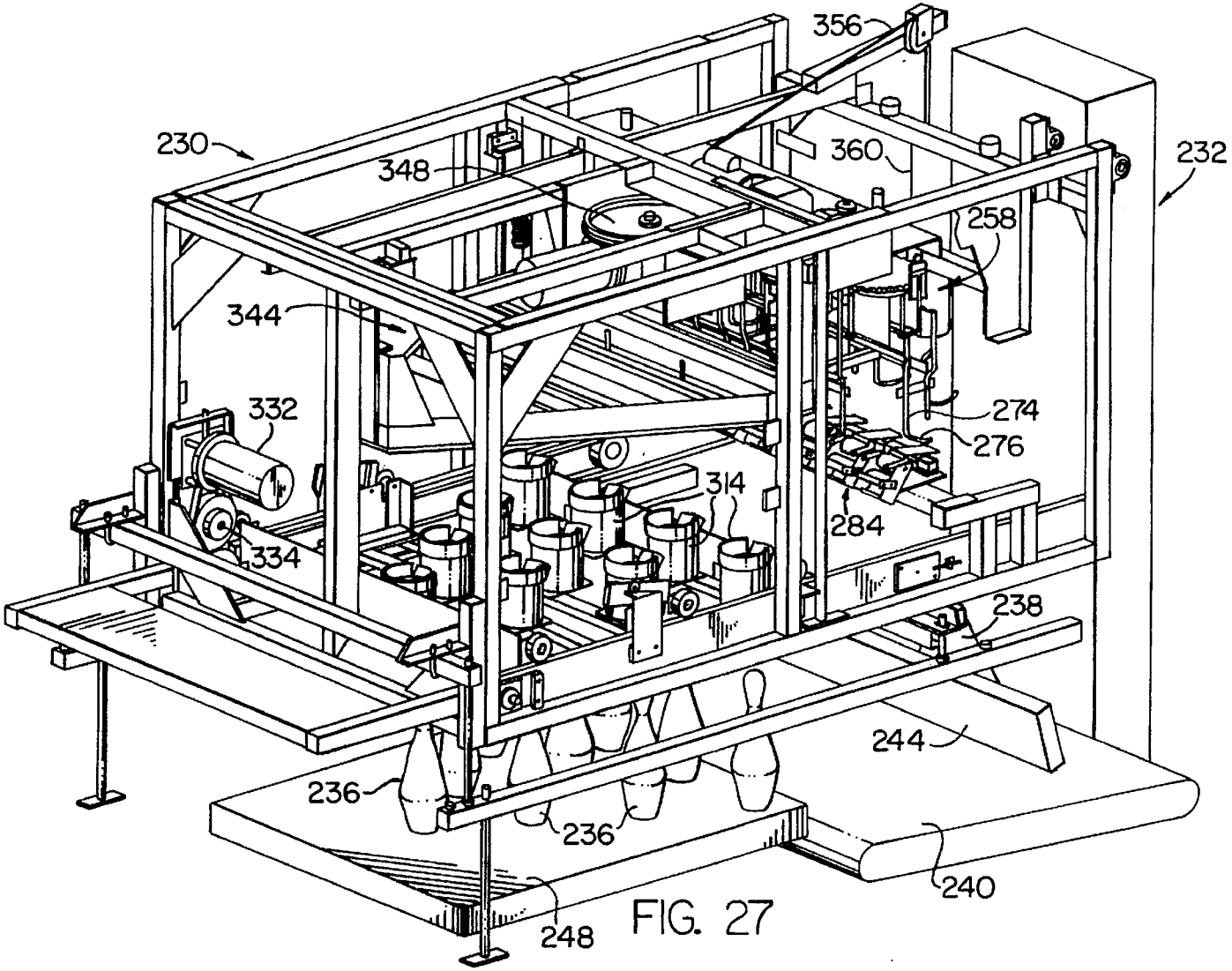
FIG. 27 is a perspective view showing an automatic pinsetter forming a second embodiment of the present invention.

Referring now to FIG. 27 et sequa, a second embodiment of the present invention is illustrated in the form of an automatic pinsetter indicated generally at 230. The pinsetter has an elevator mechanism indicated generally at 232 in outline form in FIG. 27 and in more detail in a somewhat schematic perspective view in FIG. 28. The elevator mechanism 232 is or may be conventional and includes a vertically extending series of "flights" or shelves 234,234 which are spaced apart and adapted to carry bowling pins 236 individually with the pins oriented in either direction horizontally. That is, the bowling pins 236 may have their head and bottom or "butt" ends in reverse orientation as in the two bowling pins shown on upper shelves 234,234 in FIG. 28. A pyramid shaped baffle or buffer element 238 disposed in front of the elevator at its lower end portion tends to prevent jamming of bowling pins on a rearwardly moving belt 240 and assists in the delivery of the pins to the upwardly moving shelves 234,234. The shelves 234,234 may be belt or chain driven by conventional means not shown for continuous upward movement within side frames 242,242 of the elevator. Spaced forwardly of the pyramid shaped element 238 is a bridge member 244 which engages and directs bowling balls such as the ball 246 in a leftward direction in FIG. 28 across the belt 240 but which is elevated above the belt 240 a sufficient distance to allow bowling pins 236 to pass therebeneath. The belt 240 is inclined leftwardly and has its front end portion adjacent and somewhat below a rear end of a bowling alley 248 so as to effectively receive all bowling pins falling from a rear end portion of the alley.

Figure 28:
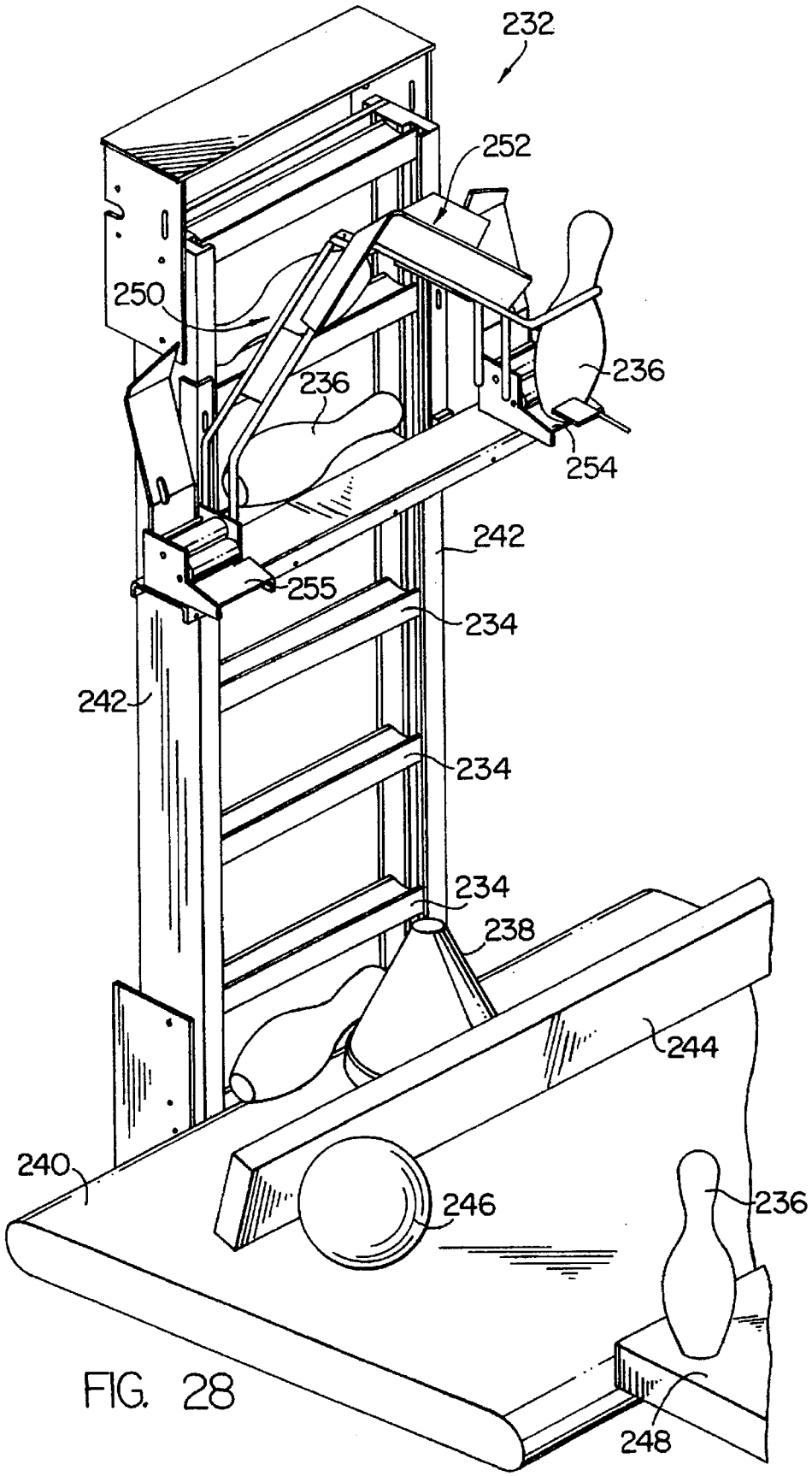
FIG. 28 is a perspective view showing an elevator mechanism of the FIG. 27 embodiment of the automatic pinsetter.

At an upper end portion of the elevator 232, pins such as the uppermost pin 236 in FIG. 28 are urged forwardly by a pusher means not shown so as to fall anguarly downwardly through left or right-hand chute devices indicated generally at 250,252. Chute devices 250,252 accept bowling pins 236,236 and direct the same leftwardly or rightwardly depending upon the orientation of the pins on the shelves 234,234. That is, pin 236 with its head end shown at the left and its butt end at the right, due to the weight of the butt end exceeding the weight of the head end will obviously fall downwardly to the right in the chute 252 onto a platform 254 in arriving in an upright attitude. The next succeeding pin 236 on shelf 234 beneath the top pin, due to the weight of its butt end, will fall down the left-hand chute 250 so as to arrive in an upright position as shown by the upright pin 236 on platform 255 at a lower end portion of the chute 250.

Figure 29:
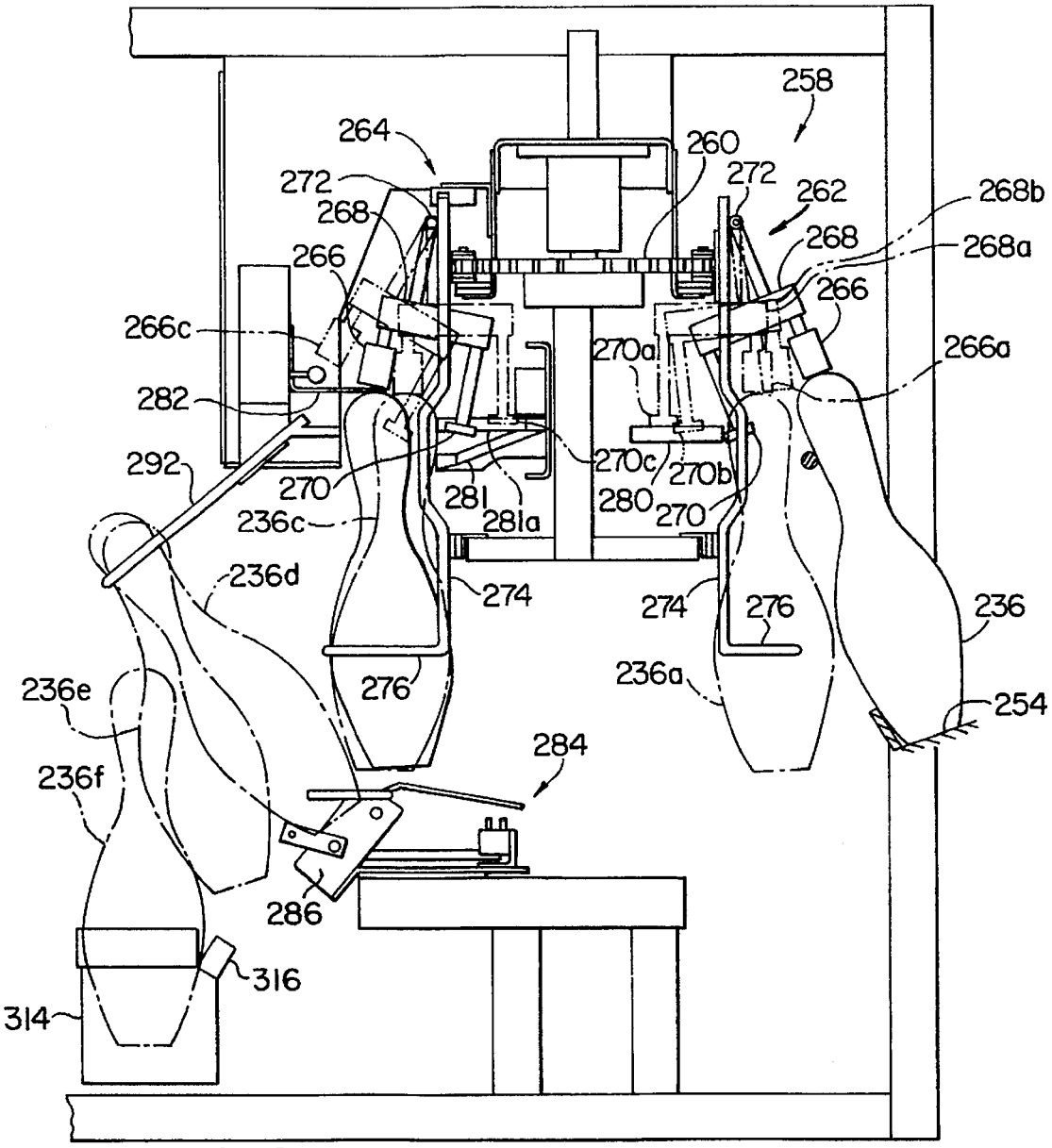
FIG. 29 is an enlarged fragmentary view in elevation showing a portion of a transfer mechanism including a conveyor, a discharge device for removing bowling pins from the conveyor, a holder forming a part of a collator, and an upwardly open cradle for receiving a bowling pin.

In FIG. 29, a bowling pin 236 is shown on the right-hand platform 254 of FIG. 28 and in position to be picked-up by bowling pin handling device indicated generally at 258. The handling device 258 includes a conveyor which may take a chain or belt form at 260 and which includes a loading or pick-up run 262 which extends horizontally across the pinsetter and a discharge run 264 which also extends horizontally across the pinsetter and which moves in an opposite direction with respect to the run 262. The conveyor 260 may be operated continuously by power drive means such as a DC motor not shown and carries a plurality of magnet means in the form of permanent magnets 266,266 mounted on a similar plurality of carrier bars 268,268 each of which also carries a depending cam follower 270. The carrier bars 268 are pivotally mounted as at 272 with the magnets 266 and cams 270 depending therefrom in spaced relationship.

A plurality of permanent magnets 266, carrier bars and cams are similarly mounted in spaced relationship and progress along both the loading and discharge runs of the conveyor as illustrated in FIG. 29. Depending pin guide elements 274 are also provided and each permanent magnet device has an associated guide element which may take the form of a wire or rod which extends downwardly and which has a generally U-shaped portion 276 at a lower end to partially envelop and guide a bowling pin 236 held by a magnet 266. Especially on pick-up of a bowling pin there may tend to be a degree of swaying of the pin which might result in an inadvertent dislodgment from its magnet and guiding of the pin as well as retention of the same in vertical attitude is insured by the members 274,276.

The bar 268, magnet 266 and cam 270 shown in full line in FIG. 29 and with the magnet 266 in engagement with the head of pin 236 on the platform 254 is illustrated in the process of picking-up or "loading" the pin 236 onto the conveyor. The left-hand broken line cam follower 270*a* in FIG. 29, shown in a vertical position, is associated with a cam 280 and is shown passing above the cam 280 with a permanent magnet 266*a* attached to a bowling pin 236*a* illustrated behind bowling pin 236. The weight of-the bowling pin 236*a* on the assembly comprising the magnet 266*a*, its cross bar 268*a* and cam follower 270*a* causes the follower to ride over the top of cam 280 with a small biasing force in the mounting of the bar 268*a* overcome by the weight of the pin 236*a*. That is, a small biasing spring or the like may be provided adjacent the pivot 272 to cause the permanent magnets and supporting bars to take an intermediate position such as illustrated at 268*b* for the bar, 266*b* for the magnet and 270*b* for the cam follower. In the intermediate position shown, cam follower 270*b* will obviously engage a rear portion of the cam 280 as the conveyor 260 moves toward the viewer in FIG. 29 and an incline, not shown, on a rear portion of the cam will cause the follower to move to the position of the full line follower 270. This results in the magnet 266 being pivoted to its full line position shown in FIG. 29 for pick-up of the bowling pin 236 as aforesaid.

The bowling pin 236, having been picked-up or loaded onto the conveyor 260 as described, proceeds forwardly and thence leftwardly to the position shown at the left-hand position of FIG. 29 in broken line at 236*c*. A cam shown in an inoperative and lower position at 281 forms a part of a discharge device and is moveable upwardly to a broken line position at 281*a*. At position 281*a* the cam engages the cam follower shown in broken line at 270*c* and causes the same to pivot to the full line position 270. This in turn causes the permanent magnet to move upwardly and leftwardly to the full line position 266 and a fixed knife or knife-like separator element 282 enters the crevice thus provided between the head of bowling pin 236 and permanent magnet 266 to dislodge the bowling pin from the magnet. Continued upward and leftward movement of the permanent magnet to the broken line position 266*c* insures a clean and effective separation of the bowling pin from its supporting magnet 266.

Figure 30:
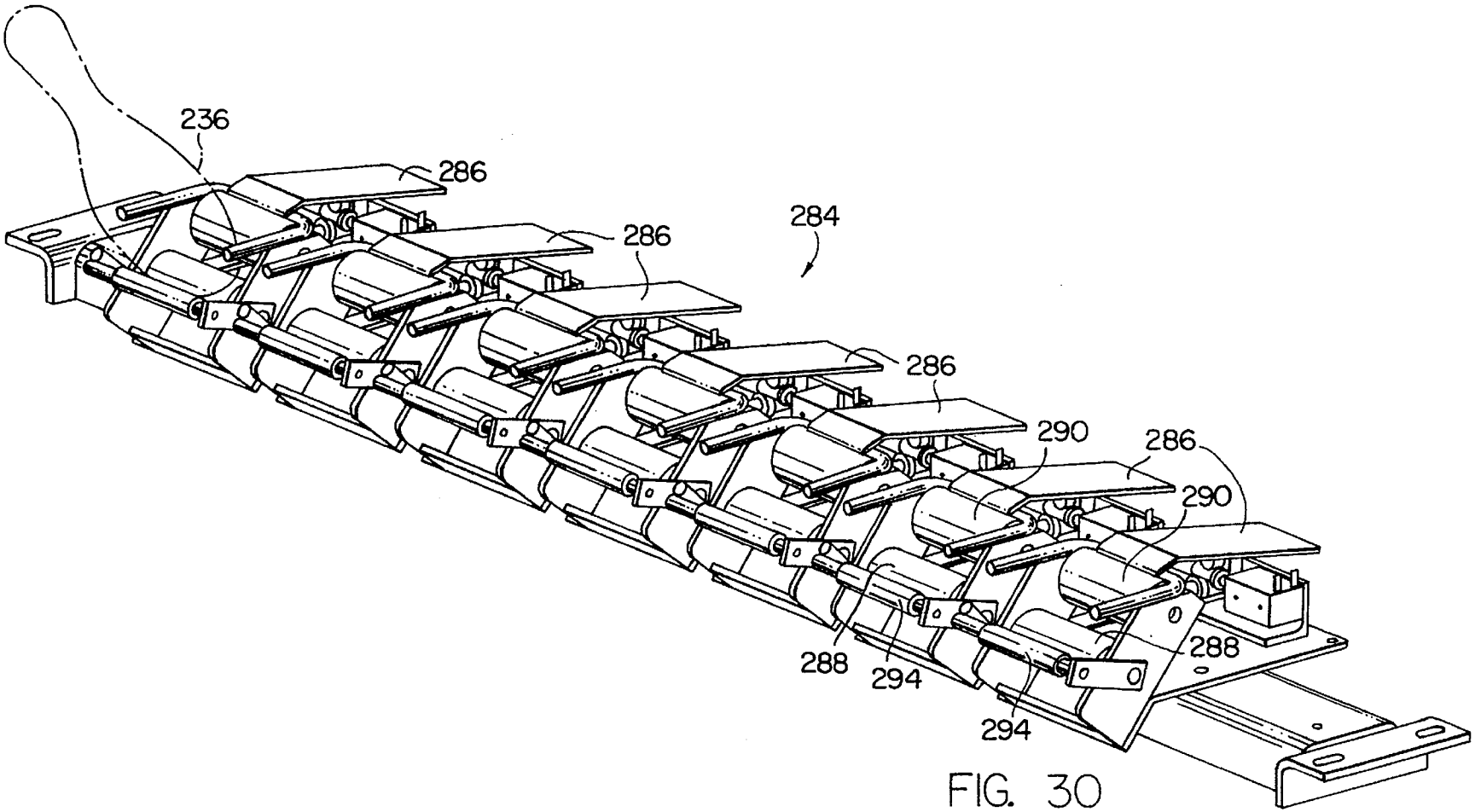
FIG. 30 is a perspective view showing a series of pin holders forming the collator of the present invention.

Referring now to FIG. 30, a collator for the bowling pins discharged from the conveyor and handling device 258 is indicated generally at 284 and preferably comprises a series of seven (7) bowling pin holders 286,286 as illustrated. The pin holders 286,286 are arranged horizontally and laterally in series in the pinsetter as illustrated in FIG. 27 and preferably have associated therewith a series of seven (7) discharge devices as described above. That is, bowling pins 236 are discharged from the conveyor 260 by the dislodgment of the pins from the permanent magnets at seven (7)

stations spaced apart along the conveyor and extending across the automatic pinsetter. Substantially more than seven (7) permanent magnets may of course be provided on the conveyor so as to provide for a ready supply of bowling pins for discharge to the pin holders 286,286 of the collator 284. Pins may be discharged individually or two or more or as many as seven pins may be discharged substantially in unison from the conveyor 260 to the collator 284. As will be explained more fully hereinbelow, three (3) pins are collected or collated by the collator 284 at the center portion of the collator in one discharge operation and seven (7) bowling pins are collected or collated in the collator 284 in another discharge operation. Control may of course be exercised by an appropriate controller operating to move cams 281,281 from their full line inoperative positions to their upper and broken line operative positions.

Reverting now to FIG. 29, the full line pin 236 shown at the left-hand side of the view falls from its magnet 236 at the urging of the knife or knife-like element 282 into a pin holder 286 disposed therebeneath. Each pin holder 286 comprises front and rear rollers 288,290 spaced and arranged at an angle so as to allow the bowling pin to swing downwardly and leftwardly in FIG. 29 for retention by a bale or hook 292. That is, bale or hook 292 receives and holds an upper end portion of a bowling pin with a lower or butt end portion thereof engaging the rollers 288,290 in a pin holder. The lower end portion of the bowling pin such as broken line pin 236*d* is restrained by a small gate roller 294 so as not to fall out of its pin holder. Thus, it will be readily understood that three (3) pins can beheld in the three centermost pin holders 286,286 or seven (7) pins may be held in the seven pin holders 286,286.

Figure 31:
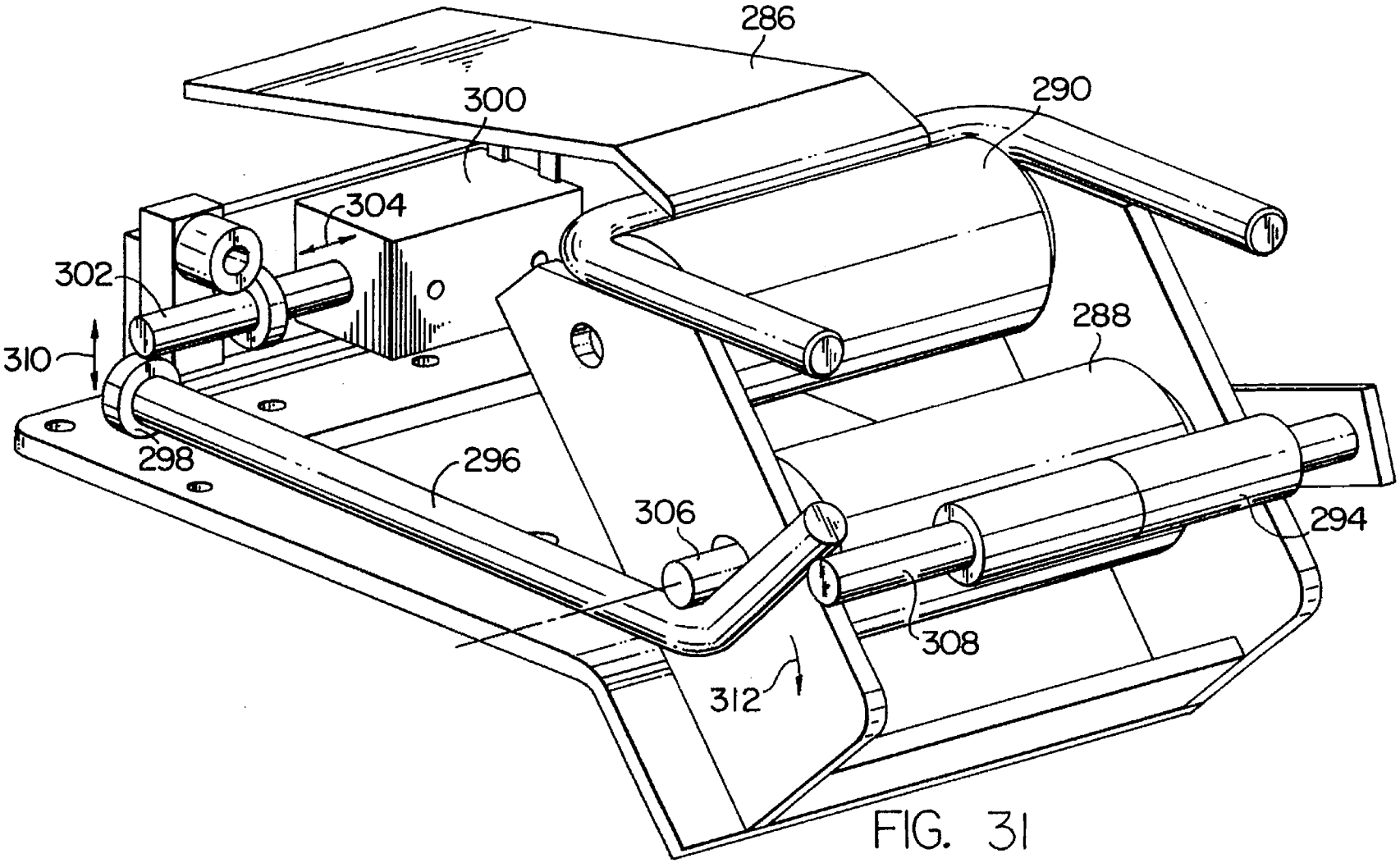
FIG. 31 is an enlarged perspective view of a single pin holder of FIG. 30.

Release of-the bowling pins from their holders will best be understood with reference to FIG. 31. An actuating arm 296 has a rear end portion provided with a small counterweight 298 and has an associated solenoid 300 with a plunger 302 moveable toward and away from a position above the counterweight 298 as illustrated by arrows 304. The actuating arm 296 at its front end portion, is welded or otherwise attached to shaft 306 associated with the front and lower roller 288 of the pin holder 286 and shaft 308 associated with gate roller 294 which retains the bowling pin in the pin holder. The weight of the bowling pin against the roller 294 will tend to pivot the actuating arm 296 upwardly at a rear end position as illustrated by arrow 310. With the plunger 302 in the position shown, however, the actuating arm is prevented from so moving and the roller 294 is held in position to secure the lower end portion of a bowling pin 236*d* in the pin holder. On withdrawal of the plunger 302 rightwardly in FIG. 31, the rear end portion of the actuating arm 296 will pivot upwardly with the shaft 306 turning in a clockwise direction in FIG. 31 whereby to similarly rotate the roller 288 and to swing the gate roller 294 in the direction shown by the arrow 312 downwardly and forwardly thus releasing the lower end portion of the bowling pin. The slight rotation of the roller 288 will also tend to cause the lower end portion of the bowling pin to fall from the pin holder 286 as better illustrated at 236*e* in broken line form in FIG. 29. When the lower end portion of the bowling pin has been released by the roller 294 the counterweight 298 returns the actuating arm 296 and the roller 294 to the position shown in FIG. 31 and the plunger 302 is once again returned to the left-hand or extended position shown retaining the counterweight 298 and the actuating arm 296 and the roller 294 in the full line position of FIG. 31.

Returning now to FIG. 29, the bowling pin shown in broken line at 236*e*, having been released from the pin holder 286, tends to swing in a clockwise direction about its upper end portion at the urging of gravity whereby to assume a substantially vertical position as illustrated at 236*f* with its butt end portion deposited in an upwardly open cradle 314. A small guide member 316 at a rear end portion of the cradle may assist in directing the lower or butt end portion of the bowling pin into the cradle in its descent from an associated pin holder 286.

Figure 32:
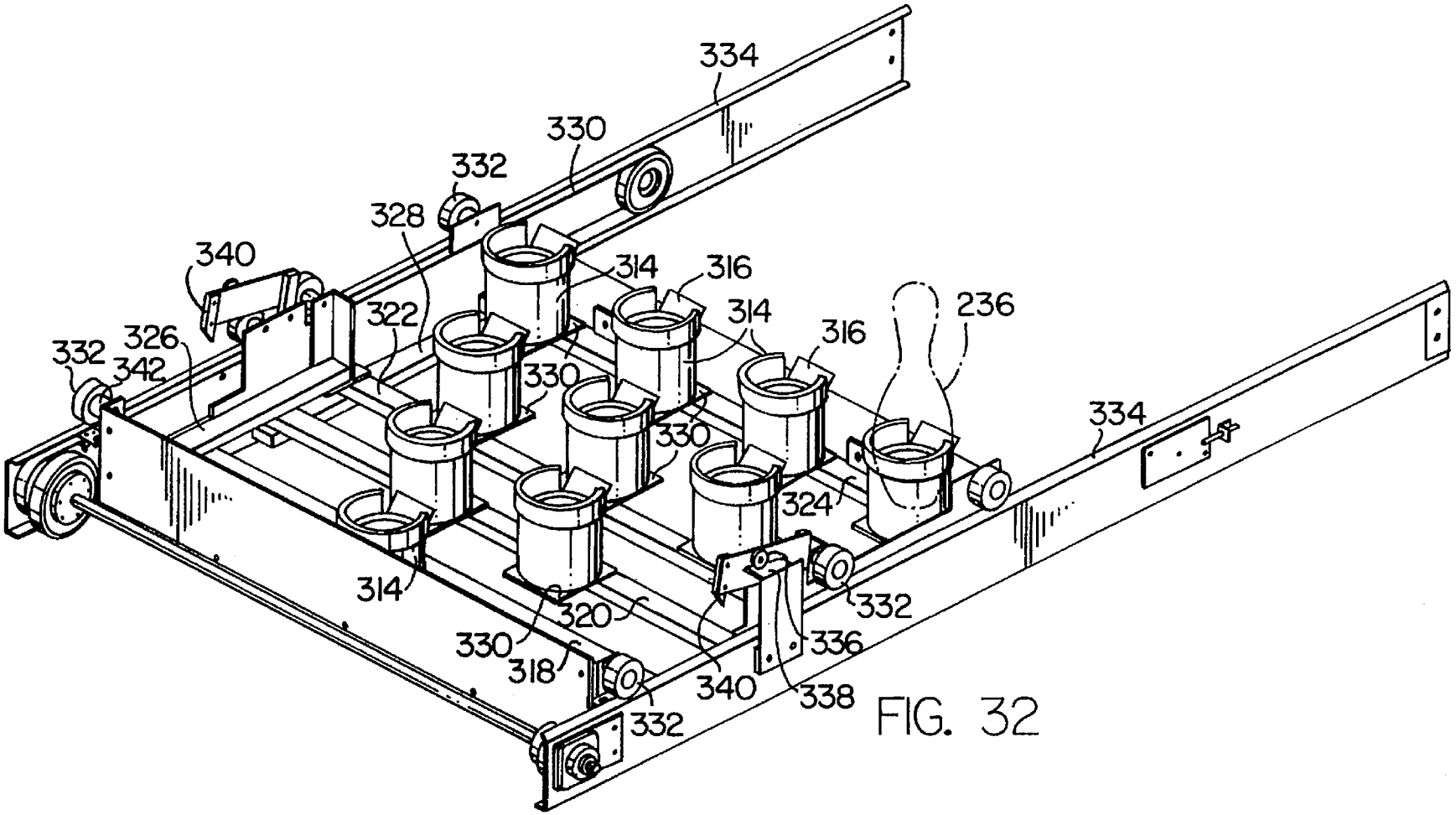
FIG. 32 is a fragmentary perspective view of a carrier forming a part of the transfer mechanism of the pinsetter and including a plurality of cradles on the carrier in an expanded and a conventional triangle bowling array.

FIGS. 32 through 36 illustrate a carrier and a cradle assembly also forming a part of the transfer device of the present invention and which is expandable and collapsible horizontally in the longitudinal direction of the automatic pinsetter whereby to contribute importantly to the compact longitudinal configuration of the pinsetter. In FIG. 32 ten (10) upwardly open cradles 314,314 are provided for a conventional triangular bowling array with ten (10) bowling pins. The cradles are so shown in FIG. 32 for removal of bowling pins from the carrier by a pinsetting mechanism and for the subsequent deposit of the pins on the bowling alley therebeneath following horizontal withdrawal of the carrier. Carrier elements in the form of horizontal and laterally extending slats 318,320,322,324 are provided for supporting the cradles 314,314. The slat 318 supports the front or "lead" cradle 314, while the slat 320 supports the second row of two (2) cradles, the slat 322 the third row of three (3) cradles and the slat 324 the fourth and rearwardmost row of four (4) cradles. The slats 318 and 322 are connected together longitudinally by connector elements 326 as are the slats 320 and 324 by longitudinal connector elements 328. Further, the cradles 314,314 are mounted on small platforms 330,330 which project laterally from their respective slats so as to offset the cradles laterally from the slats in opposite directions on adjacent slats. That is, the cradle 314 on the slat 318 is offset laterally rearwardly relative to its slat with two (2) cradles 314,314 on the slat 320 offset laterally forwardly. The three (3) cradles 314, on the slat 322 are offset laterally rearwardly with the four (4) cradles 314, on the slat 324 offset forwardly. Due to-the offset of the cradles and the corresponding conventional spacing of bowling pins in a triangular array, the cradles on the slats 318 and 320 can be aligned in a series or row of three (3) cradles extending laterally of the automatic pinsetter. Similarly, the cradles on the slats 322 and 324 can be aligned in a series or row of seven (7) cradles extending laterally of the pinsetter. The manner in which this is accomplished is described hereinbelow.

Figure 33:
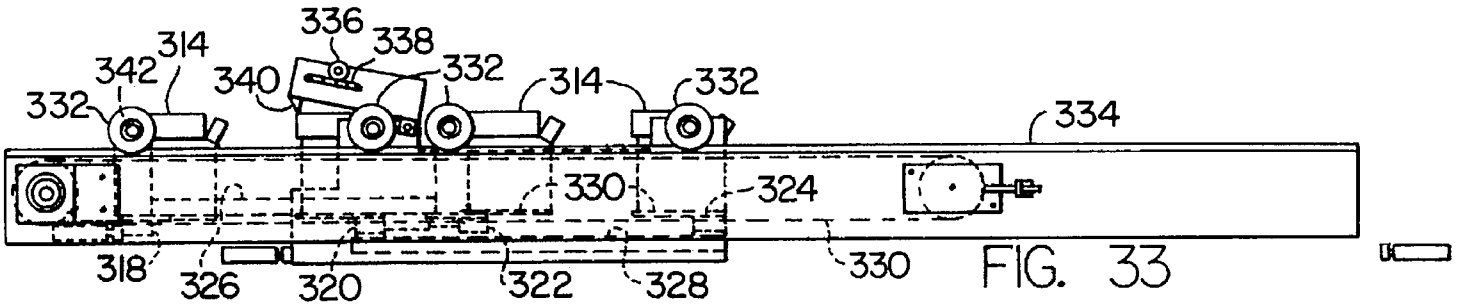
FIG. 33 is a side view of the carrier and cradles of FIG. 32 with the carrier and cradles in expanded condition and with the cradles in triangular bowling array.
Figure 34:
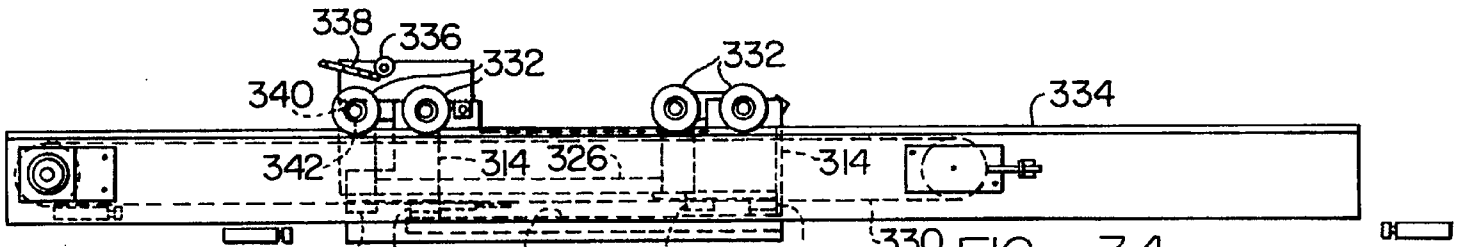
FIG. 34 is a view similar to FIG. 33 but with the cradles and carrier in an intermediate position.
Figure 35:
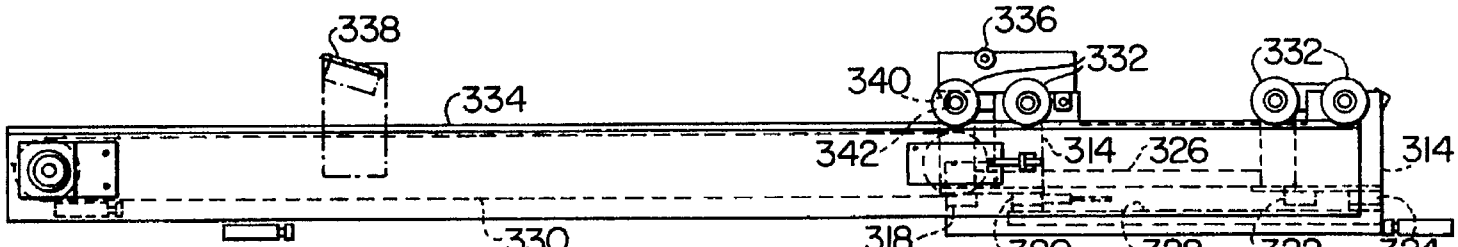
FIG. 35 is a view similar to FIG. 34 but with the carrier and cradles in a contracted position with the cradles in first and second linear series or rows.
Figure 36:
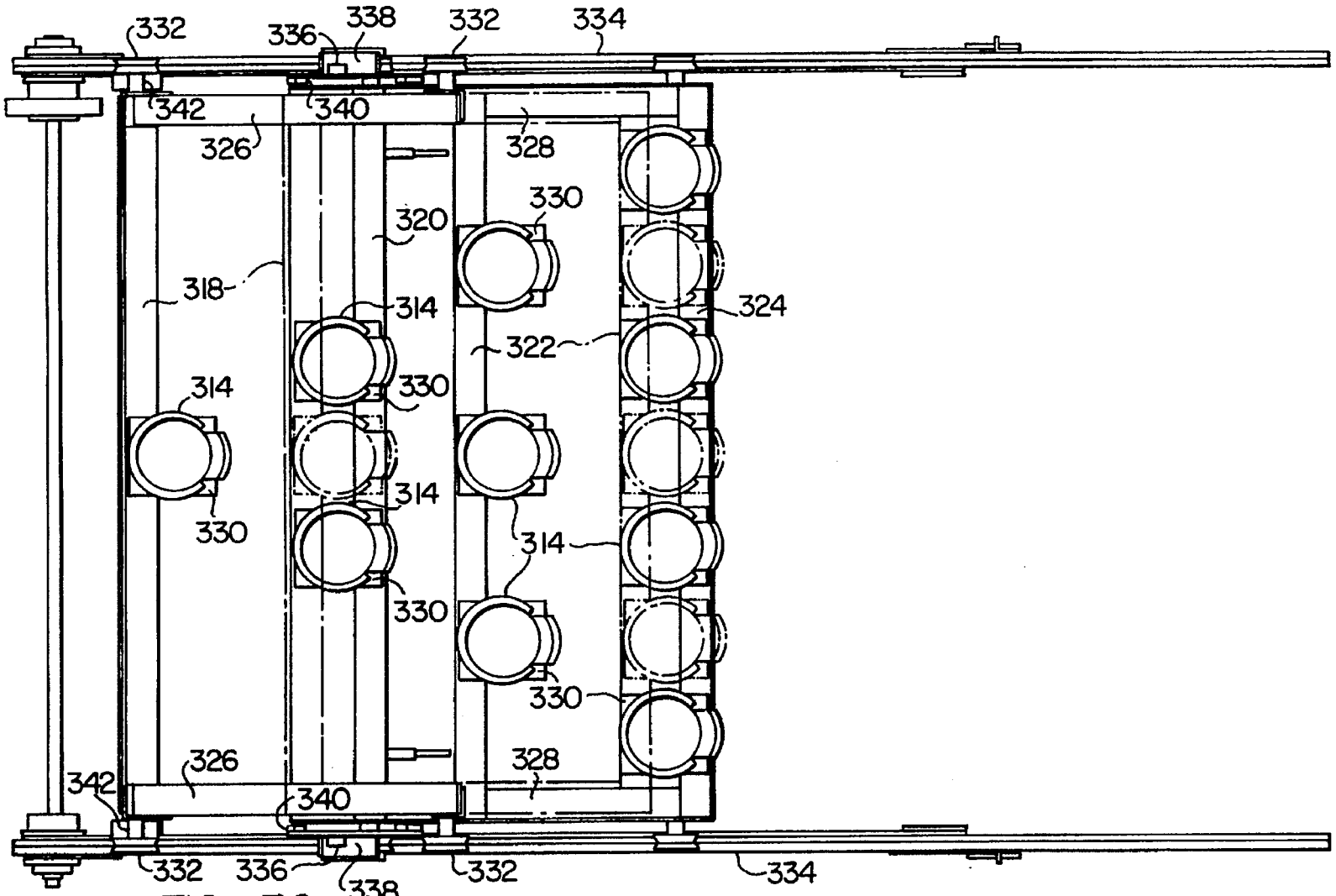
FIG. 36 is a top view of the carrier and cradles of FIGS. 32 through 35 with the carrier and cradles in the contracted condition of FIG. 35 in broken line and in the expanded condition of FIGS. 33 and 34 in full line.
Figure 37:
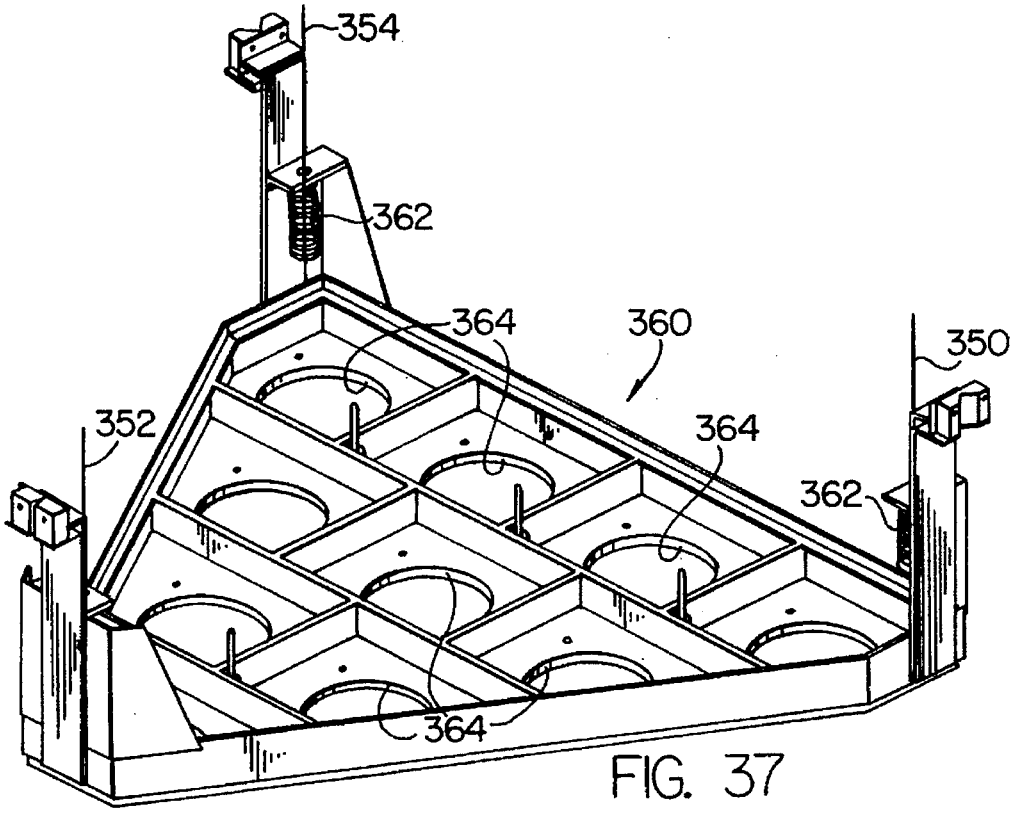
FIG. 37 is a fragmentary perspective view of the interior of a vertically moveable pinsetting mechanism and showing a plurality of small containers for holding floatable magnets.

Referring now to FIGS. 32 and 33, it will be observed that chain or belt drives 330 extend horizontally with upper and lower runs on each side of the carrier. The belts or chains 330 may be operated by a suitable DC electric motor 332 in FIG. 27 through appropriate gearing 334. With a forward end portion of the carrier adjacent the slat 318 attached to a lower run of belt or chain 330, and with the lower run moving rearwardly as in FIG. 34, the slats 318 and 322 will be moved rearwardly as illustrated whereby to bring the slats 318 and 320 in close proximity to each other and the slats 322 and 324 similarly in close proximity. In this arrangement of the slats, the cradles 314 on the slats 318 and 320 are aligned laterally in a series of three as illustrated in FIG. 36 and the cradles on the slats 322 and 324 are aligned in a series of seven cradles. In FIG. 36, a series of small rollers 332,332 travel along side rails 334,334 to support the slats 318–324 and their cradles 314,314 and, a pair of the rollers 336,336 serve to operate a latching mechanism. That is, the rollers 336,336 co-operate with small inclined members 338,338 on forward and rearward movement of the slats to unlatch and latch the slats 318,320. In FIG. 33 the rollers 336,336 have been raised by the inclined members 338,338 to lift small associated latches 340,340. The latches 340,340 drop into operative position to engage shaft 342 of the forwardmost rollers 332,332 as illustrated in FIG. 34 when the carrier is retracted rearwardly to the FIG. 34 position. Thus, with the latches engaged with the shaft 342, the slats 318,320,322,324 are retained in their relative position on further movement of the slats rearwardly to the position of FIG. 35. On subsequent forward movement of the forwardmost slat 318 at the urging of the lower run of the belt or chain 330, the small cam rollers 336,226 again engage the inclined members 338,338 and release the shaft 342 of the forwardmost rollers 332,332 whereby to allow full expansion of the carrier with the cradles arranged as illustrated in FIGS. 32 and 33.

The reason for the aforementioned deposit of three (3) bowling pins at the center portion of the collator 284 in the holders 286,286 of the collator will now be better appreciated. The forwardmost series of cradles in FIG. 35 including three (3) cradles as illustrated in FIG. 36 reside initially in a loading operation at the position of the cradle 314 in FIG. 29. As will be apparent actuation of the solenoids 300,300 of the three (3) centermost pin holders will result in discharge of three pins from the holders and deposit of the same in the three cradles 314,314. Subsequently, and on completion of a limited forward movement of the lower run of the chain 330 bringing the rear seven (7) cradles to the position of the front three cradles in FIG. 35, seven (7) bowling pins may be deposited in the cradles from the collator 284. In the interim, it is of course necessary to refill the three centermost holders of the collator for the discharge in unison of seven (7) pins from the collator to the seven rear cradles on the carrier.

A desired mode of operation will now be readily apparent with three (3) cradles filled from the collator 284 initially followed by the filling of the seven (7) rearwardly disposed cradles and the subsequent full forward movement and expansion of the carrier to the FIG. 32 and 33 condition. With the carrier expanded, the desired triangular array of the bowling pins on the bowling alley is simulated and it is possible for the bowling pins to be removed from their cradles in unison and in the desired arrangement by a pinsetting mechanism of the machine.

A pinsetting mechanism indicated generally at 344 in FIG. 27 is similar to those described above and is moveable vertically from a position above the carrier and cradles 314 as illustrated to cause magnets thereon to lift pins from the cradles 314. Thereafter and on rearward removal of the carrier, the pins are deposited on the bowling alley in bowling array as illustrated. Further, the pinsetting mechanism can be lowered to cause its magnets to engage the heads of one or more pins which may remain standing after a first ball has been thrown. Pins, whether "on spot" or "off spot" can then be raised to allow "deadwood" to be cleared from the alley by a sweeper not shown but which may be conventional in configuration.

Figure 41:
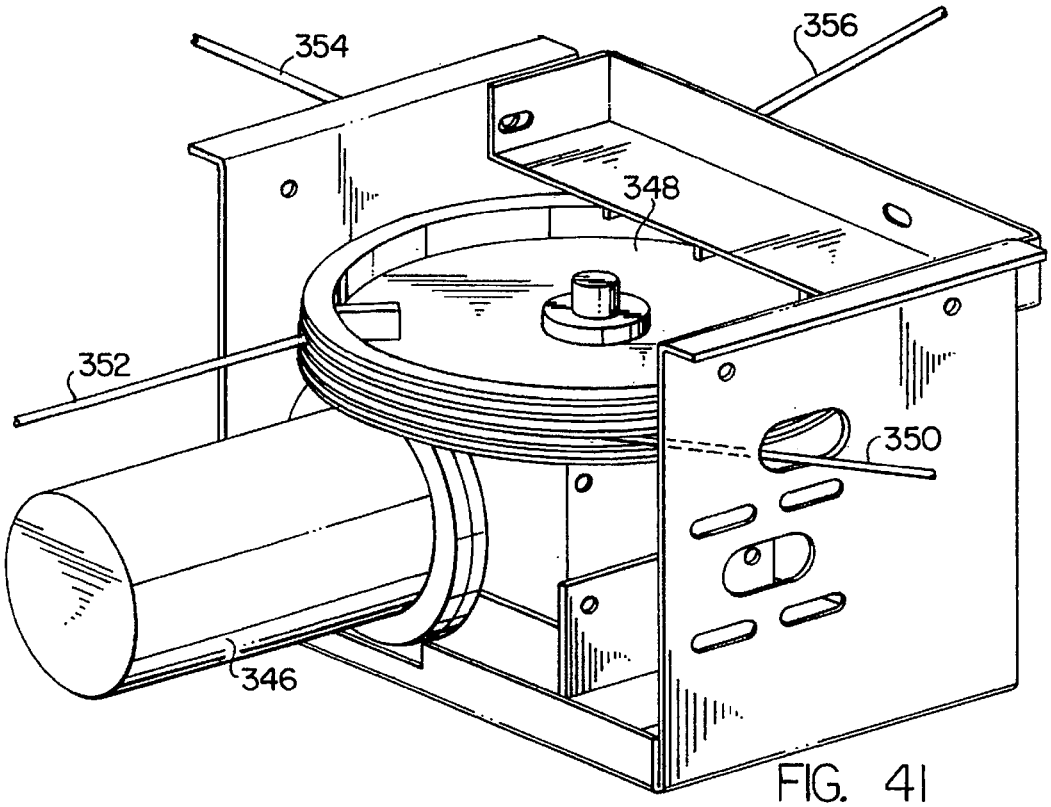
FIG. 41 is a perspective view of an electric motor and pulley forming a part of a power operating means for the pinsetting mechanism.

FIG. 41 illustrates a DC motor 346 operating a pulley 348 having three (3) lines 350,352,354 operatively associated therewith for raising and lowering the pinsetting mechanism. Preferably, a line 356 extends rearwardly to a counterweight 360 as best illustrated in FIG. 27. A suitable controller for the motor is of course provided to cooperate with an overall machine controller in the timed raising and lowering operation of the pinsetting mechanism.

Figure 38:
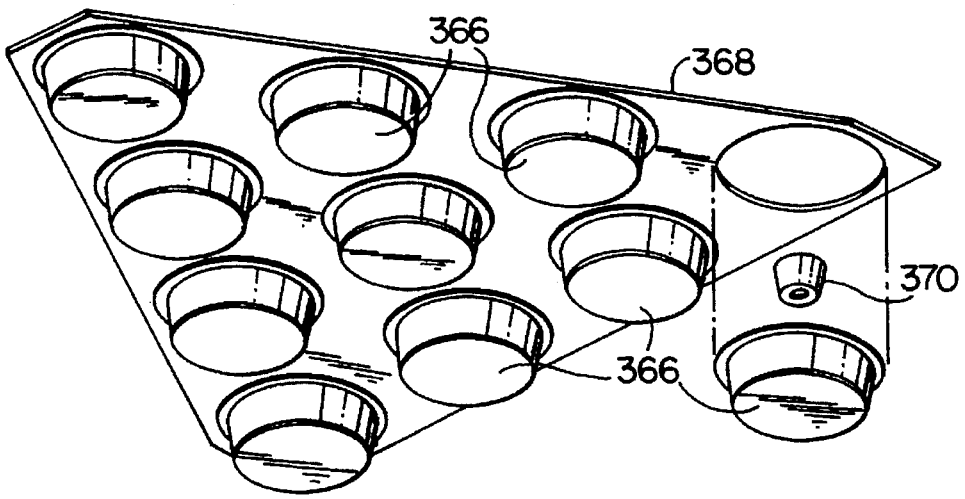
FIG. 38 is a perspective view of the pinsetting mechanism from beneath the same with the containers projecting downwardly from the mechanism.

Each of the lines 350–354 is attached to the frame by means of a relatively stiff spring 362, two shown. Ten (10) similar openings 364 arranged in triangular bowling array in the frame 360 receive ten (10) small containers 366 best illustrated in FIG. 38. As shown, the small containers 366 may be mounted on and carried collectively by a plate 368. Each of the containers 366 has a float 370 therein which carries a small permanent magnet 372 best illustrated in FIGS. 39 and 40. Further, a liquid 374 in the container causes the float to assume a normal or inoperative elevated position of FIG. 39 when the magnet 372 is spaced from a magnetically attractive material. The liquid may comprise water mixed with ordinary automotive anti-freeze.

Figure 40:
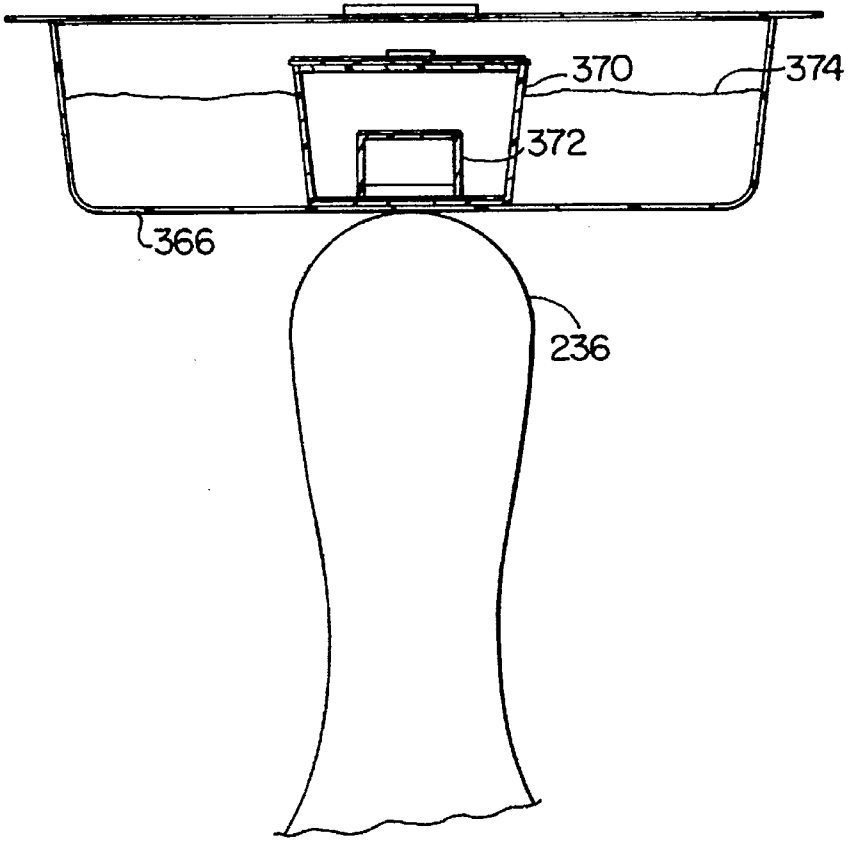
FIG. 40 is a view similar to FIG. 39 but with the head of the bowling pin engaging the bottom of the container holding the floatable magnet.
Figure 39:
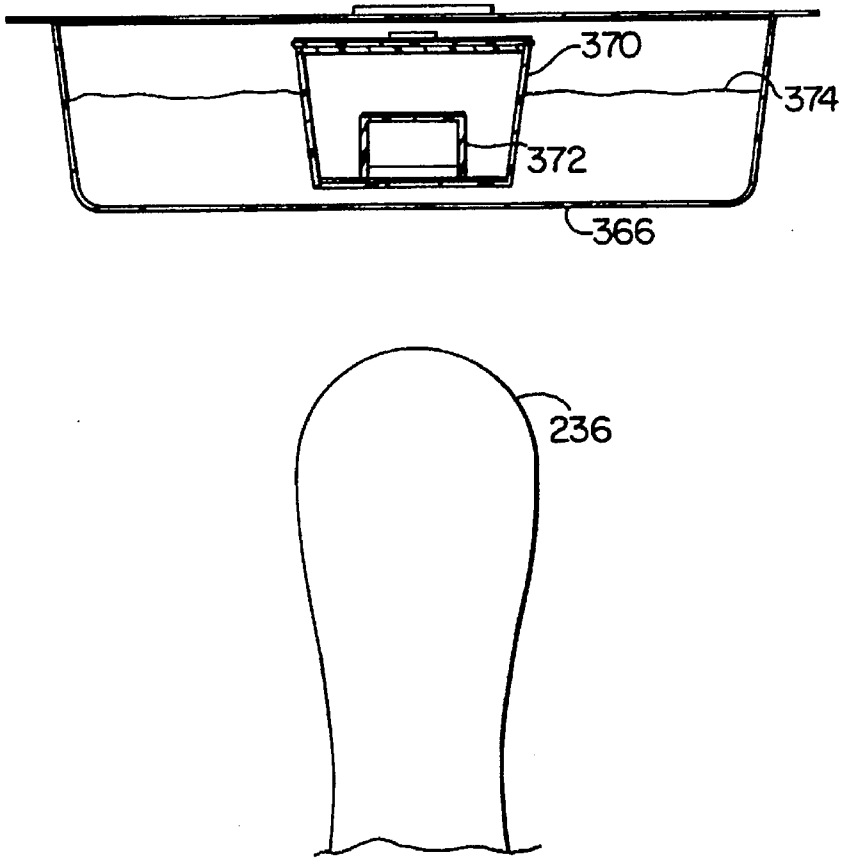
FIG. 39 is a schematic view showing a head portion of a bowling pin and an enlarged container and floatable magnet of the pinsetting mechanism, the head of the bowling pin being disposed beneath and in spaced relationship with the container.

As will be apparent, the magnet float assemblies 370,372 are capable of a limited degree of horizontal movement as required in seeking the head of a bowling pin which is in an "off spot" position on the bowling alley in a deadwood clearing operation. When a bowling pin is "on spot" or arranged in a cradle 314 as illustrated in FIGS. 39 and 40, the float 370 and its magnet 372 merely moves vertically downwardly to engage the lower wall of its container 366 whereby to exert magnetic influence and holding force on the magnetically responsive head of a bowling pin therebeneath.

The mode of attachment or pick-up of a bowling pin will now readily apparent from the foregoing. Merely by lowering the pinsetting mechanism to an appropriate level, the bowling pins therebeneath will be engaged by the bottom walls of the containers 366 with their associated magnets 372 exerting the necessary force on the magnetically responsive bowling pin heads to effect a pick-up or attachment operation. In the simplified construction of the present embodiment, separating and other means are found unnecessary in thereafter detaching the bowling pins from the magnets and containers 366,366. That is, it has been found that a sharp upward acceleration of the pinsetting mechanism achieved by a fast start of the DC motor 346 is capable of a "snap action" release of the bowling pins. The weight and inertia of the bowling pins is sufficient to cause the bowling pins to be released or detached from the containers 366 in an efficient manner with such rapid upward acceleration. Thus, after a carrier and cradle unloading operation and subsequent to the deposit of the pins in bowling array on the bowling alley, the pinsetting mechanism can be rapidly accelerated in its initial upward movement to cause a "snap action" release of the bowling pins. Similarly, in a deadwood clearing operation, a rapid upward acceleration of the pinsetting mechanism achieves the desired release of replaced or reset bowling pins.

Figure 42:
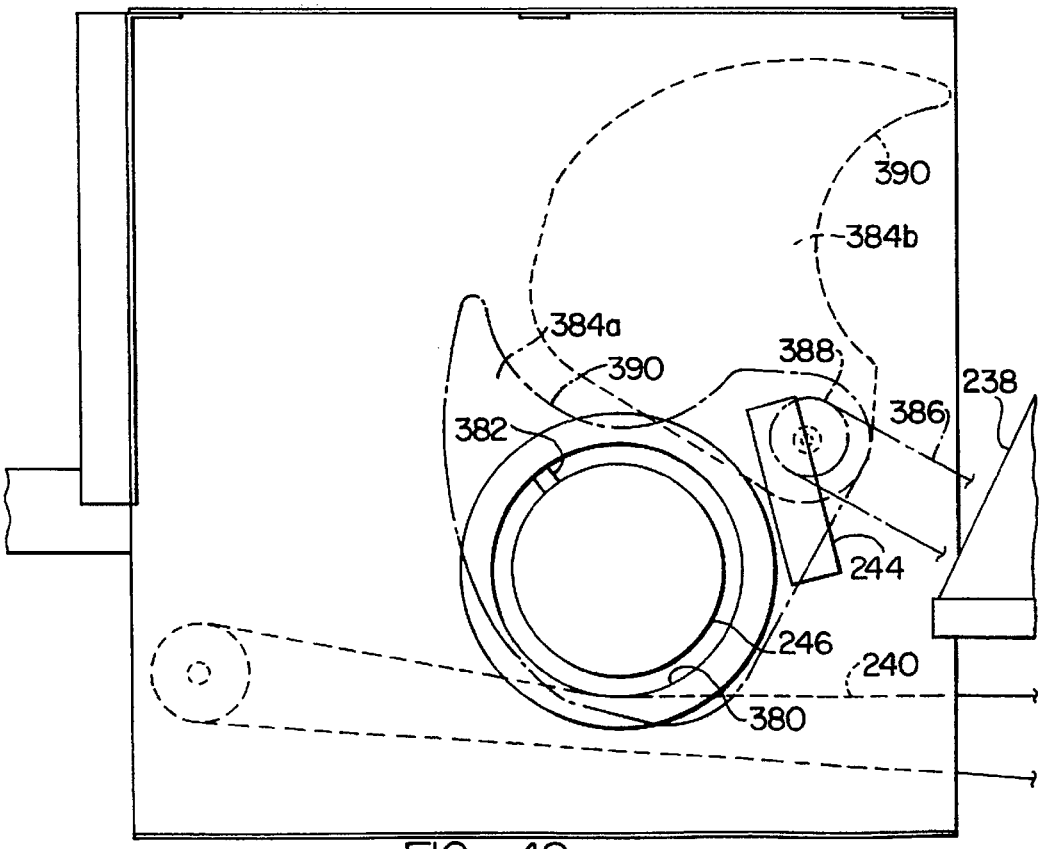
FIG. 42 is a somewhat schematic side view of a ball retrieval device.

In FIG. 42, there is illustrated a bowling ball retrieval mechanism which operates in conjunction with the forementioned bridge 244 and inclination of the conveyor serving to direct a ball such as the ball 246 in FIG. 28 toward a side wall of the bowling alley. An opening 380 in the side wall has an associated sensor or switch member 382 which controls operation of a door or gate 384. The door or gate 384 may be operated by a belt 386 and pulley 388 for a single revolution in the discharge of each bowling ball 246 to a ball return conveyor (not shown) which may be conventional. The door 384 closes the opening 380 in its broken line position 384*a* and in its full line position 384*b* opens the door for the passage of a bowling ball. Preferably, the door is rotatable in a clockwise direction with a concave front or leading edge at 390. The concave leading edge 390 tends to deflect bowling pins which may inadvertently reach the area of the door opening 380. Thus, the inadvertent or unintended discharge of bowling pins through the opening 380 is prevented.

Figure 26:
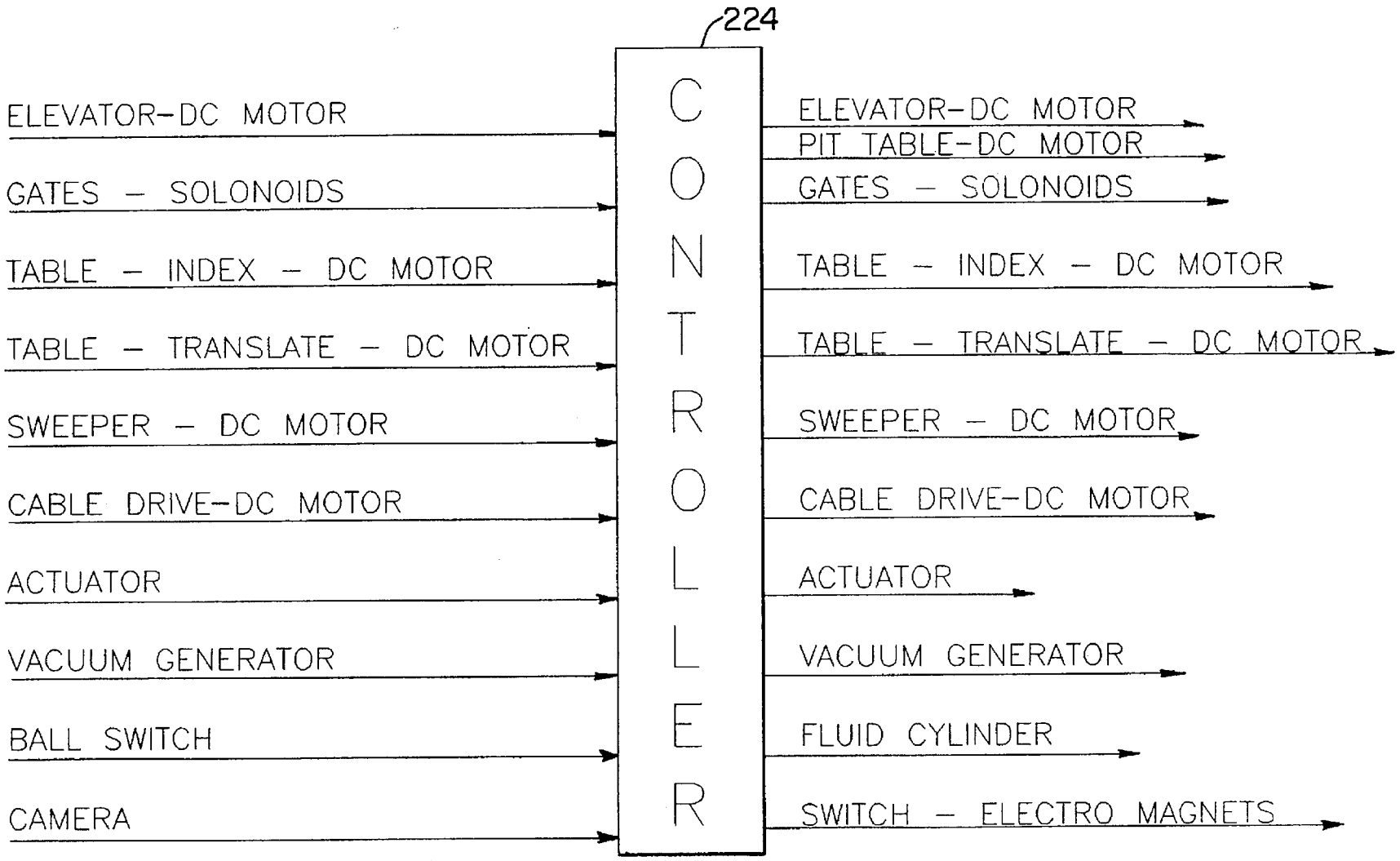
FIG. 26 is a schematic view in block diagram form of a controller for the automatic pinsetter of the present invention.

Control means for the pinsetter may vary widely within the scope of the invention and may take the form of a conventional microprocessor appropriately programmed to time and interrelate the various machine functions described above. A camera 222 is illustrated schematically in FIG. 1, arranged to view the rear portion of the bowling alley 16 together with pins thereon, and may form a part of a control means in co-operation with a controller 224 in FIG. 26. As mentioned, drive means for the various pinsetter elements may take the form of DC motors and accordingly, the controller has both input and output signals for the various DC motors. Position, speed, acceleration, and other feedback signals may of course be provided to the controller from the various motors as well as the control signals from the controller to the motors. For example, it may be desirable to supply the controller with a signal representative of the indexed position of the table 34 in determining the appropriate control signal to be sent to solenoids of the gates 38,38. Similarly, control signals to the cable drive DC motor in raising and lowering the pinsetting mechanism must of course be coordinated with the control signals to a DC motor operating the sweeper mechanism. A ball switch signal to the controller is of course necessary in the timing of the control signals to the vacuum generator for the suction cup and the fluid cylinder for the rod carrying the cup. Other similar timed and interrelated functions may be attended to by the controller in a conventional manner.

The camera 222 has not been mentioned above and serves to enhance the operating efficiency of the automatic pinsetter. For example, if a bowler throws a "gutter ball" on his first attempt, there is no need for the pinsetting mechanism 20 to descend and raise the remaining upright pins for a sweeping operation. Accordingly, on receipt of such a signal the controller advises the pinsetting mechanism to remain in its elevated position and significant savings in time in the cycle of operation of the setter is achieved. Similarly, after a second ball has been thrown, the camera may inform the controller whether or not upright or fallen pins remain on the bowling alley and the sweeping mechanism is operated accordingly. Still further, when a "strike" is thrown by the bowler, the controller is so advised and operates the pinsetter to immediately provide a new bowling array on the alley through operation of the transfer mechanism, pinsetting mechanism etc. Other refinements in operation are also possible with the camera 222 and the controller 224.

From the foregoing it will be apparent that the automatic pinsetter of the present invention is of a relatively simplified and compact design and construction and is yet capable of highly efficient operation and long life with a minimum of maintenance and repair. The number of operating parts in the pinsetter is drastically reduced over that in prior art pinsetters from the thousands to the hundreds.

We claim:

1. An automatic pinsetter for use in retrieving magnetically responsive bowling pins from a pit area adjacent a rear end of a bowling alley and for arranging and depositing the same on the bowling alley; said pinsetter comprising a pin discharge station, an elevator mechanism operable to retrieve bowling pins from the pit area and to transport the same upwardly to said pin discharge station, a pin delivery station, a transfer mechanism operable to receive bowling pins discharged from said elevator mechanism and to transfer the pins to said pin delivery station, a vertically movable pinsetting mechanism positioned above and operable to accept the pins at said pin delivery station and to deposit the same on the bowling alley, said pinsetting mechanism including magnetic means for selectively magnetically holding and releasing the magnetically responsive pins whereby to remove the same from said transfer mechanism and thereafter to deposit the same on the bowling alley.

2. An automatic pinsetter as set forth in claim 1, including individual pin retrieval means operatively associated with said elevator mechanism to pick up bowling pins individually from said pit area.

3. An automatic pinsetter as set forth in claim 1, wherein said bowling pins are magnetically responsive at upper end portions, wherein said pin retrieval means includes magnetic means and wherein said pins are picked up by said magnetic means in upright attitude and are thereafter maintained in upright attitude by said elevator mechanism, said transfer mechanism, and said pinsetter mechanism.

4. An automatic pinsetter as set forth in claim 1, wherein said elevator mechanism comprises an endless conveyor extending generally vertically from the pit area to said pin discharge station, the latter being located above and in spaced relationship with the bowling alley, and wherein said pin retrieval means comprises a plurality of magnets carried by the conveyor and spaced apart therealong, each of said magnets serving to pick-up a magnetically responsive bowling pin at said pit area in passage therethrough.

5. An automatic pinsetter as set forth in claim 4, wherein ten (10) bowling pins are accommodated by the pinsetter, and wherein from five (5) to nine (9) magnets are provided in substantially equally spaced relationship along said conveyor.

6. An automatic pinsetter as set forth in claim 4, wherein said bowling pins are magnetically responsive at upper end portions and are carried in depending upright attitude by said pin retrieval magnets, and wherein at least one gate is provided at said pin discharge station and is operable to discharge pins from said conveyor to said transfer mechanism.

7. An automatic pinsetter as set forth in claim 6, wherein said transfer mechanism includes an indexible rotary table having a plurality of upwardly open cradles for receiving and holding bowling pins in upright attitude, and said gate and table being operable in timed relationship whereby to deposit a bowling pin in each of said cradles.

8. An automatic pinsetter as set forth in claim 7, wherein said conveyor extends generally horizontally and linearly for a substantial distance at said discharge station, and wherein at least two horizontally spaced apart gates are provided at said discharge station adjacent the linear path of movement of said conveyor, said gates being operable selectively and in timed relationship with rotary indexing movement of said table to deposit a bowling pin in each of said cradles, at least two of said cradles being located at different radial distances from the center of the table.

9. An automatic pinsetter as set forth in claim 7, wherein a means is provided for moving said rotary indexible table between said pin discharge station and said transfer mechanism delivery station, the latter being spaced above and in vertical alignment with the desired location of a bowling array on the bowling alley.

10. An automatic pinsetter as set forth in claim 1, wherein said bowling pins are magnetically responsive at upper end portions, and wherein said pinsetting mechanism includes a plurality of magnets in a substantially co-planar horizontal arrangement corresponding with a desired bowling array on the bowling alley therebeneath.

11. An automatic pinsetter as set forth in claim 1, wherein said pinsetting mechanism has an intermediate position above said transfer mechanism at its delivery station for the pick-up of bowling pins therefrom, said pinsetting mechanism being movable upwardly in a pin pick-up operation and, on withdrawal of said mechanism substantially horizontally from its delivery station, said pinsetting mechanism being further movable vertically downwardly for deposit of the pins on the bowling alley.

12. An automatic pinsetter as set forth in claim 1, wherein said pinsetting mechanism includes a plurality of small containers associated respectively with and each containing a magnet, wherein said magnets are each provided with float means and said containers are each at least partially liquid filled, said magnets thus being free for limited horizontal and vertical movement in their respective containers, the horizontal movement accommodating pin head seeking operation by the magnets and the vertical movement accommodating downward movement into engagement with the bottom of the container and a resulting pin holding operation of the magnet.

13. An automatic pinsetter as set forth in claim 12, wherein each container has a spring biased vertically slidable member associated therewith to initially engage and hold down the head of a pin thus holding the same against tilting and other displacement prior to the magnet descending to a pin holding position in the container, and the slidable member also serving at the urging of its biasing spring to hold the pin down during upward movement of the container and magnet thus positively disengaging the pin from the influence of the magnet.

14. A pinsetting mechanism for use in an automatic pinsetter for depositing magnetically responsive bowling pins on a rear end portion of a bowling alley; said mechanism being moveable to and away from a pin discharge position for depositing bowling pins on the alley, and said mechanism including magnetic means for selectively holding and releasing magnetically responsive pins whereby to pick-up the pins and to deposit the same on the bowling alley, wherein said magnetic means includes a plurality of small containers each containing a magnet, wherein said magnets are each provided with float means and said containers are each at least partially liquid filled, said magnets being free for limited horizontal and vertical movement in their respective containers, the horizontal movement accommodating pin head seeking operation of the magnets and the vertical movement accommodating downward movement into engagement with the bottom of the container and resulting pin holding operation of the magnets.

15. An automatic pinsetter for retrieving magnetically responsive bowling pins from a pit area adjacent a rear end of a bowling alley and for depositing the same on a rear end portion of the bowling alley; a pin discharge station, an elevator mechanism operable to retrieve bowling pins from the pit area and to transport the same upwardly to said pin discharge station, a pin delivery station; a transfer mechanism operable to receive bowling pins from said elevator mechanism and transfer the pins in generally horizontally forwardly to said pin delivery station, a vertically movable pinsetting mechanism positioned above said pin delivery station and operable to pick-up the pins at said station and to lower and deposit the same on the bowling alley, said pinsetting mechanism including magnetic means for selectively magnetically holding and releasing the magnetically responsive pins whereby to lift the same from said transfer mechanism at said delivery station and thereafter to deposit the same on the bowling alley.

16. An automatic pinsetter as set forth in claim 15, wherein said transfer mechanism includes a carrier with a plurality of upwardly open cradles, said cradles being arranged to receive a plurality of bowling pins in upright attitude and to deliver the same to said pin delivery station beneath said pinsetting mechanism.

17. An automatic pinsetter as set forth in claim 16, wherein said carrier is expandable and contractible horizontally whereby to arrange its cradles in at least one linear row in a contracted condition and in a bowling array in its expanded condition, and wherein said transfer mechanism also includes a pin handling device operable to receive pins from said elevator and to deliver the same to said cradles in said linear row arrangement with the carrier contracted, said carrier thereafter being expanded to deliver the pins in bowling array to said delivery station beneath the pinsetting mechanism.

18. An automatic pinsetter as set forth in claim 17 wherein at least ten (10) magnetically responsive bowling pins are provided with said bowling array including ten (10) pins in a conventional triangular arrangement, wherein ten (10) corresponding cradles are provided on said carrier and arranged selectively in parallel linear rows and in said conventional triangular array, said two (2) linear rows respectively including three (3) and seven (7) cradles.

19. An automatic pinsetter as set forth in claim 18, wherein the linear row of three (3) cradles corresponds to the front pin and the usual second row of two laterally spaced pins disposed rearwardly of the front pin in a conventional triangular array, and wherein the linear row of seven (7) cradles corresponds to the usual third row of three (3) laterally spaced pins in the bowling array aligned linearly with the usual fourth row of four (4) laterally spaced pins in the bowling array.

20. An automatic pinsetter as set forth in claim 19, wherein said carrier includes a forwardmost horizontally moveable carrier element mounting the forward most cradle, a second carrier element parallel to and movable horizontally with and relative to said forwardmost element and mounting said second row of two (2) spaced cradles, a third carrier element parallel to and movable horizontally with and relative to said first and second elements and mounting said third row of three (3) spaced cradles, and a fourth element parallel to and movable horizontally with and relative to said foregoing elements and mounting said fourth row of four (4) spaced cradles.

21. An automatic pinsetter as set forth in claim 20, wherein said carrier elements take the form of elongated parallel slats movable laterally and having their respective cradles offset laterally in opposite directions on alternate slats so as to arrange the cradles of adjacent slats in longitudinal alignment when the slats are moved relative to each other into interengaging relationship.

22. An automatic pinsetter s set forth in claim 17 wherein said transfer device includes a bowling pin collator having a linear series of pin holders adapted to discharge a plurality of pins simultaneously to said cradles in the contracted condition of the carrier, and at least one pin discharge device operable selectively to accommodate the passage of bowling pins thereby and to discharge bowling pins to said collator.

23. An automatic pinsetter as set forth in claim 22, wherein the transfer mechanism includes a conveyor which extends generally horizontally and linearly for a substantial distance adjacent said collator, and wherein at least two horizontally spaced apart discharge devices are provided adjacent the linear path of movement of said conveyor, said devices being operable selectively to deliver pins to said collator.

24. An automatic pinsetter as set forth in claim 23, wherein each of said pin holders has an associated moveable gate for retaining a bowling pin therein, and wherein a means for operating each gate is provided whereby selectively to discharge bowling pins from their holders.

25. An automatic pinsetter as set forth in claim 24, wherein said conveyor includes a plurality of magnetic means spaced therealong respectively for holding magnetically responsive bowling pins in upright attitude and in depending relationship therebeneath, and wherein said discharge devices include selectively operable means for dislodging bowling pins from their magnetic means and thereby causing the same to fall into the pin holders of the collator, the latter being disposed generally beneath the discharge devices.

26. An automatic pinsetter as set forth in claim 25, wherein means for dislodging the bowling pins from the magnetic means take the form of knife-like members each operable in a severing action adjacent the top of the head of a bowling pin and the bottom of a magnetic means to separate the two and to thereby cause the bowling pin to fall into an adjacent pin holder.

27. An automatic pinsetter as set forth in claim 26, wherein a loading station is provided adjacent the path of movement of said conveyor, and wherein an elevator mechanism is provided for lifting bowling pins from a pit at the rear of the bowling alley and for introducing the same to said loading station in an upright attitude, said permanent magnets engaging the heads of the bowling pins at the loading station and holding the same for transport by the conveyor.

28. An automatic pinsetter as set forth in claim 22, wherein ten (10) cradles are provided with the cradles arranged in a first row of three cradles and a second row of seven cradles in the contracted condition of the carrier and wherein seven (7) pin holders are provided in the collator for selective discharge of three bowling pins in unison and seven bowling pins in unison to the cradles.

29. An automatic pinsetter as set forth in claim 15, wherein said transfer mechanism includes a carrier with a plurality of upwardly open cradles, said cradles being arranged to receive and hold a plurality of bowling pins in upright attitude and to deliver the same to said pin delivery station beneath said pinsetting mechanism, and wherein said transfer mechanism also includes a bowling pin collator arranged to discharge pins to said cradles and associated pin discharge devices for loading bowling pins into the collator, said mechanism also including a conveyor for receiving bowling pins from an elevator mechanism and for delivering the same to the collator at the urging of said discharge devices.

30. An automatic pinsetter as set forth in claim 29, wherein the carrier is expandable and contractible horizontally so as to selectively arrange its cradles in linear adjacent rows in a contracted condition and in a conventional triangular bowling array in an expanded condition, wherein the collator includes a linear series of pin holders adapted to discharge a plurality of pins simultaneously to said cradles in the contracted condition of the carrier.

* * * * *